US005413040A

United States Patent [19]

Sugiyama et al.

[11] Patent Number: 5,413,040

[45] Date of Patent: May 9, 1995

[54] SHEET REVERSING APPARATUS FOR SHEET-FED ROTARY PRESS WITH REVERSING MECHANISM

[75] Inventors: Hiroyuki Sugiyama; Kenji Kida, both of Ibaragi, Japan

[73] Assignee: Komori Corporation, Tokyo, Japan

[21] Appl. No.: 298,577

[22] Filed: Aug. 31, 1994

[30] Foreign Application Priority Data

Sep. 2, 1993 [JP] Japan ..... 5-240325

[51] Int. Cl.[6] ..... B41F 5/02

[52] U.S. Cl. ..... 101/230; 101/410; 271/82; 271/277

[58] Field of Search ..... 101/415.1, 408, 409, 101/410, 411, 185, 145, 230, 232, 183; 271/82, 277

[56] References Cited

U.S. PATENT DOCUMENTS

| | | | |
|---|---|---|---|
| 3,884,146 | 5/1975 | Ruetschle | 101/230 |
| 3,992,993 | 11/1976 | Kühn et al. | 101/230 |
| 4,014,261 | 3/1977 | Becker | 101/410 |
| 4,122,773 | 10/1978 | Wirz | 101/230 |
| 4,241,658 | 12/1980 | Ricciardi | 101/230 |
| 4,241,659 | 12/1980 | Fischer | 101/230 |
| 4,362,105 | 12/1982 | Iwamoto | 101/410 |
| 4,448,125 | 5/1984 | Kawaguchi et al. . | |
| 4,457,231 | 7/1984 | Kawaguchi | 101/230 |
| 4,823,695 | 4/1989 | Kida | 101/230 |
| 4,831,929 | 5/1989 | Saito | 101/230 |
| 5,136,946 | 8/1992 | Becker | 101/230 |
| 5,213,035 | 5/1993 | Becker | 101/230 |
| 5,335,597 | 8/1994 | Helmstädter | 101/410 |
| 5,365,845 | 11/1994 | Becker | 101/230 |

*Primary Examiner*—Eugene H. Eickholt

*Attorney, Agent, or Firm*—Blakely, Sokoloff, Taylor & Zafman

[57] ABSTRACT

A sheet reversing apparatus for a sheet-fed rotary press with a reversing mechanism includes a paper convey cylinder, gaps, a reversing mechanism, a paper holding unit, a gripper moving unit, and a gripper pad moving unit. The gripper moving unit moves the gripper member of the paper holding unit from the gap to an outer surface of the paper convey cylinder in accordance with a pivotal movement of the paper convey cylinder. The gripper pad moving unit moves, in accordance with the pivotal movement of the paper convey cylinder, the gripper pad member of the paper holding unit between an operating position and a retreat position.

8 Claims, 17 Drawing Sheets

SHEET REVERSING APPARATUS FOR SHEET-FED ROTARY PRESS WITH REVERSING MECHANISM

BACKGROUND OF THE INVENTION

The present invention relates to a sheet reversing apparatus for a sheet-fed rotary press with a reversing mechanism, which has upstream and downstream cylinders with respect to a paper convey direction and a paper convey cylinder disposed therebetween to be in contact with each other and reverses a paper sheet upon gripping and conveyance of the paper sheet between the upstream cylinder and the paper convey cylinder, thereby performing perfecting printing.

Various sheet-fed rotary presses with reversing mechanisms each capable of performing single-sided printing and perfecting printing have been proposed and put into practice along with a variety of printing techniques. An example of such a rotary press is disclosed in U.S. Pat. No. 4,448,125. This rotary press has double-diameter impression cylinders on the upstream and downstream with respect to a paper convey direction and a reversing cylinder disposed therebetween to serve as a double-diameter paper convey cylinder. This apparatus will be described below.

FIGS. 18 to 23 show a sheet-fed rotary press with a reversing mechanism disclosed in this prior art. FIG. 18 shows the cylinder arrangement. FIG. 19 shows a paper holding unit and a paper trailing end holding unit. FIG. 20 corresponds to FIG. 19 and shows the paper holding unit and the paper trailing end holding unit in a state wherein the paper trailing end holding unit holds the trailing end of a paper sheet to transfer the paper sheet to the paper holding unit. FIG. 21 shows the cylinder arrangement for a single-sided printing operation. FIGS. 22 to 24 show the cylinder arrangements for a perfecting printing operation.

Referring to FIG. 18, in each of adjacent printing cylinders, i.e., in each of first and second printing units 1 and 2, a plate cylinder 3 having a plate mounted thereon and a blanket cylinder 4 having a blanket wound thereon are arranged to be pressed against each other. A double-diameter impression cylinder 5 as an upstream cylinder with respect to the paper convey direction is in contact with the blanket cylinder 4 of the printing unit 1.

A double-diameter impression cylinder 6 as a downstream cylinder with respect to the paper convey direction is pressed against the blanket cylinder 4 of the printing unit 2. A double-diameter reversing cylinder 7 is arranged between the impression cylinders 5 and 6 to be pressed against each other.

A plurality of sets of gripper units 8 each having grippers and gripper pads and serving as a paper holding unit are aligned along the axial direction of the impression cylinder 5 at positions which divide the circumference of the impression cylinder 5 into halves. Similarly, a plurality of sets of gripper units 9 are aligned along the axial direction of the impression cylinder 6 at positions which divide the circumference of the impression cylinder 6 into halves.

Reversing gripper units 10 are aligned along the axial direction of the reversing cylinder 7 at positions which divide the circumference of the reversing cylinder 7 into halves. The positions of the reversing gripper units 10 are set to oppose the gripper units 8 and 9 upon rotation of the cylinders 5 to 7. A plurality of suction levers 11 connected to a suction air source such as a pump (not shown) are arranged near the reversing gripper units 10 at positions which divide the circumference of the reversing cylinder 7. A swinging unit 12 grips a paper sheet 15 fed onto a feeder board 14 to transfer the paper sheet 15 to the gripper unit 8 of the impression cylinder 5.

With the above structure, in single-sided printing shown in FIG. 21, when the cylinders 5 to 7 and the like are rotated, the paper sheet 15 is gripped by the gripper unit 8 and conveyed. When the paper sheet 15 passes between the blanket cylinder 4 and the impression cylinder 5, printing of the first color is performed on the paper sheet 15. The paper sheet 15 is gripped from the gripper unit 8 to the reversing gripper unit 10 which operates as in a conventional gripper unit, wound on the lower-side surface of the reversing cylinder 7, and conveyed. The paper sheet 15 wound on the reversing cylinder 7 is gripped from the reversing gripper unit 10 to the gripper unit 9 of the impression cylinder 6 and conveyed. When the paper sheet 15 passes between the blanket cylinder 4 and the impression cylinder 6, printing of the second color is performed on the same surface as in the first-color printing operation.

When such single-sided printing is to be switched to perfecting printing, the phase of the upstream cylinder group including the impression cylinder 5 with respect to the paper convey direction is adjusted such that the trailing end of the paper sheet 15 gripped by the gripper unit 8 corresponds to the suction levers 11. With this operation, the phase state shown in FIG. 21 is changed to that shown in FIG. 22. Thereafter, the printing operation is restarted. Upon rotation of the cylinders 5 to 7 and the like, the paper sheet 15 is gripped by the gripper unit 8 and conveyed. When the paper sheet 15 passes between the blanket cylinder 4 and the impression cylinder 5, printing is performed on the upper surface of the paper sheet 15. The paper sheet 15 passes through the contact point between the cylinders 5 and 7 without being gripped by the reversing gripper unit 10 at its leading end and is wound on the lower-side surface of the impression cylinder 5, as shown in FIG. 23.

When the trailing end of the paper sheet 15 wound on the impression cylinder 5 reaches the contact point between the cylinders 5 and 7, the trailing end of the paper sheet 15 is drawn by the suction levers 11 of the reversing cylinder 7 and gripped by the reversing gripper unit 10. At the same time, the leading end of the paper sheet 15 is released from the gripper unit 8. As shown in FIG. 23, the paper sheet 15 is gripped by the reversing gripper unit 10 and reversed. The paper sheet 15 is gripped from the reversing gripper unit 10 to the gripper unit 9 and conveyed by the impression cylinder 6. When the paper sheet 15 passes between the blanket cylinder 4 and the impression cylinder 6, printing is performed on the lower surface of the paper sheet 12, thereby performing perfecting printing.

The structures and operations of the suction levers 11 and the reversing gripper unit 10 will be described below in more detail with reference to FIG. 19 and 20. Gaps *7a* are formed in the outer surface of the reversing cylinder 7. A plurality of grippers of each reversing gripper unit 10 axially supported to be free to pivot are arranged in each gap *7a* at a predetermined interval along the axial direction of the cylinder. The grippers of each reversing gripper unit 10 are pivoted in the forward/reverse direction by a cam mechanism and a spring member (neither are shown). The grippers of each reversing gripper unit 10 are fixed on a gripper shaft 19 extending in the axial direction of the cylinder. Each reversing gripper unit 10 comprises boat-like gripper pad holders 21 having gripper pads 20 at their free end portions, and gripper holders 23 arranged next to the gripper pad holders 21 and having grippers 22 at their free end portions. Each gripper 22 provided to the gripper holder 23 is opened/closed by a cam mechanism (not shown) to grip the paper sheet 15 with the corresponding gripper pad 20.

A bearing 24 is fixed on the bottom surface of the gap *7a*. A tubular suction lever shaft 25 is axially supported by the bearing 24 to be free to pivot. The suction lever shaft 25 communicates with a pump or the like through a rotary valve and is pivoted through a predetermined angle in the forward/reverse direction by a cam mechanism (not shown). The plurality of suction levers 11 are fixed to the suction lever shaft 25 in correspondence with the grippers of the reversing gripper unit 10.

The perfecting printing operation of a conventional sheet-fed rotary press with a reversing mechanism having the above structure will be described. When the reversing cylinder 7 is rotated from the state as shown in FIG. 19, a paper suction surface 11*a* of the suction levers 11 reaches the contact point between the cylinders 5 and 7. Immediately before the paper suction surface 11*a* reaches the contact point, the suction levers 11 are pivoted by the cam mechanism to a position shown in FIG. 20 and escape from the gripper pad holders 21. The reversing gripper unit 10 including the gripper pad holders 21 is largely pivoted by the cam mechanism to a position shown in FIG. 20 with a small time lag. At this time, the grippers 22 of the reversing gripper unit 10 are kept closed.

During the pivotal movement of the gripper pad holders 21, the suction levers 11 escape not to interfere with the gripper pad holders 21. After the suction levers 11 have successfully escaped from the gripper pad holders 21, the suction levers 11 return to the position shown in FIG. 19. At the same time, the rotary valve is opened, and suction air acts on the suction surface 11*a* of the suction levers 11. With this operation, the trailing end of the paper sheet 15 is drawn by the suction surface 11*a*.

The suction levers 11 which draw the trailing end of the paper sheet return to the position shown in FIG. 20 again. At the same time, the grippers 22 are opened, and the trailing end of the paper sheet drawn by the suction surface 11*a* of the sucker levers 11 is gripped by the reversing gripper unit 10. Thereafter, the suction levers 11 which have released the paper sheet are pivoted to the position shown in FIG. 19. At the same time, the reversing gripper unit 10 which grips the trailing end of the paper sheet conveys the paper sheet 15 in accordance with the rotation of the reversing cylinder 7. After the paper sheet 15 is gripped from the reversing gripper unit 10 to the gripper unit 9 of the impression cylinder 6, the reversing gripper unit 10 returns to the position shown in FIG. 19.

In such a conventional sheet reversing apparatus for a sheet-fed rotary press with a reversing mechanism, however, during the perfecting printing operation, the entire reversing gripper unit 10 having the grippers 22 and the gripper pads 20 is integrally moved into the gap *7a* of the reversing cylinder 7 to avoid interference with the upstream impression cylinder 5. For this reason, the gripper pressure cannot be increased, and the paper sheet 15 is often gripped in an erroneous direction. Therefore, a printing failure occurs to degrade the quality of printed matter or increase wasted paper.

SUMMARY OF THE INVENTION

It is an object of the present invention to provide a sheet reversing apparatus for a sheet-fed rotary press with a reversing mechanism, in which a reversing mechanism is divided and sequentially retreated into a gap.

It is another object of the present invention to provide a sheet reversing apparatus for a sheet-fed rotary press with a reversing mechanism, which can increase a gripper pressure to properly grip a paper sheet.

In order to achieve the above objects of the present invention, there is provided a sheet reversing apparatus for a sheet-fed rotary press with a reversing mechanism, comprising a paper convey cylinder disposed between an upstream cylinder and a downstream cylinder with respect to a paper convey direction to be in contact with against each other, a gap formed along an axial direction of the paper convey cylinder at a position which divides a circumference of the paper convey cylinder into halves in a circumferential direction, a reversing mechanism, disposed in the gap, for holding a trailing end of a paper sheet passing through a contact point between the paper convey cylinder and the upstream cylinder and wound on the upstream cylinder, and then reversing and transferring the paper sheet to the downstream cylinder, the reversing mechanism having a paper holding unit, having a gripper member and a gripper pad member for receiving and holding the reversed paper sheet, for transferring the paper sheet held between the gripper member and the gripper pad member to the downstream cylinder, a gripper moving unit for moving the gripper member of the paper holding unit from the gap to an outer surface of the paper convey cylinder in accordance with a pivotal movement of the paper convey cylinder, and a gripper pad moving unit for moving, in accordance with the pivotal movement of the paper convey cylinder, the gripper pad member of the paper holding unit between an operating position at which a distal end of the gripper member presses a paper grip surface of the gripper pad member to grip the paper sheet and a retreat position at which a space is formed to entirely receive the gripper member moved by the gripper moving unit from the outer surface of the paper convey cylinder into the gap.

During perfecting printing, when the trailing end of the paper sheet wound on the upstream cylinder reaches the contact point between the paper convey cylinder and the upstream cylinder, the paper trailing end holding unit of the paper convey cylinder holds the trailing end of the paper sheet. When the paper convey cylinder is continuously rotated, the paper trailing end holding unit for holding the trailing end of the paper sheet released from the paper holding members of the upstream cylinder is rotated, thereby reversing the paper sheet.

When the paper sheet is to be reversed, the paper trailing end holding unit is rotated by a predetermined angle by the pivoting unit while rotating about their axis. During conveyance, the paper sheet is gripped from the paper trailing end holding unit to the grip surface between the gripper members and the gripper pad members of the paper holding unit and conveyed.

When the paper sheet is to be gripped, the gripper members retreated from the outer surface of the paper convey cylinder are moved to the operating position at which the gripper members project from the outer surface of the paper convey cylinder. At the same time, the gripper pad members retreated from the outer surface of the paper convey cylinder are also moved to the operating position. The gripper members are closed in this state, so that the paper sheet is gripped by the paper grip surface between the gripper members and the gripper pad members. Simultaneously, the paper trailing end of the paper sheet is released from the paper trailing end holding unit, and the paper sheet is held by the paper holding unit and conveyed.

Printing is performed on the lower surface of the paper sheet gripped by the paper holding unit and conveyed while the paper sheet is gripped by the paper holding unit of the downstream cylinder at the contact point between the paper convey cylinder and the downstream cylinder and conveyed. The paper trailing end holding unit which has released the paper sheet is continuously rotated along the outer surface of the paper convey cylinder toward the contact point between the upstream cylinder and the paper convey cylinder.

As for the gripping operation of the paper sheet from the paper trailing end holding unit to the paper holding unit, the gripper members can increase the gripper pressure of the paper holding unit because the movable gripper pad members are used to grip the paper sheet. Therefore, the paper sheet can be accurately gripped.

In addition, a regulating member which is brought into contact with the gripper pad members is arranged on a line of action of the pressing force of the gripper members with respect to the paper grip surface between the gripper pad members and the gripper members when the gripper pad members are at the operating position. Since deflection of the gripper pad members can be prevented, the paper sheet can be accurately transferred.

DESCRIPTION OF THE PREFERRED EMBODIMENT

Figure 1:
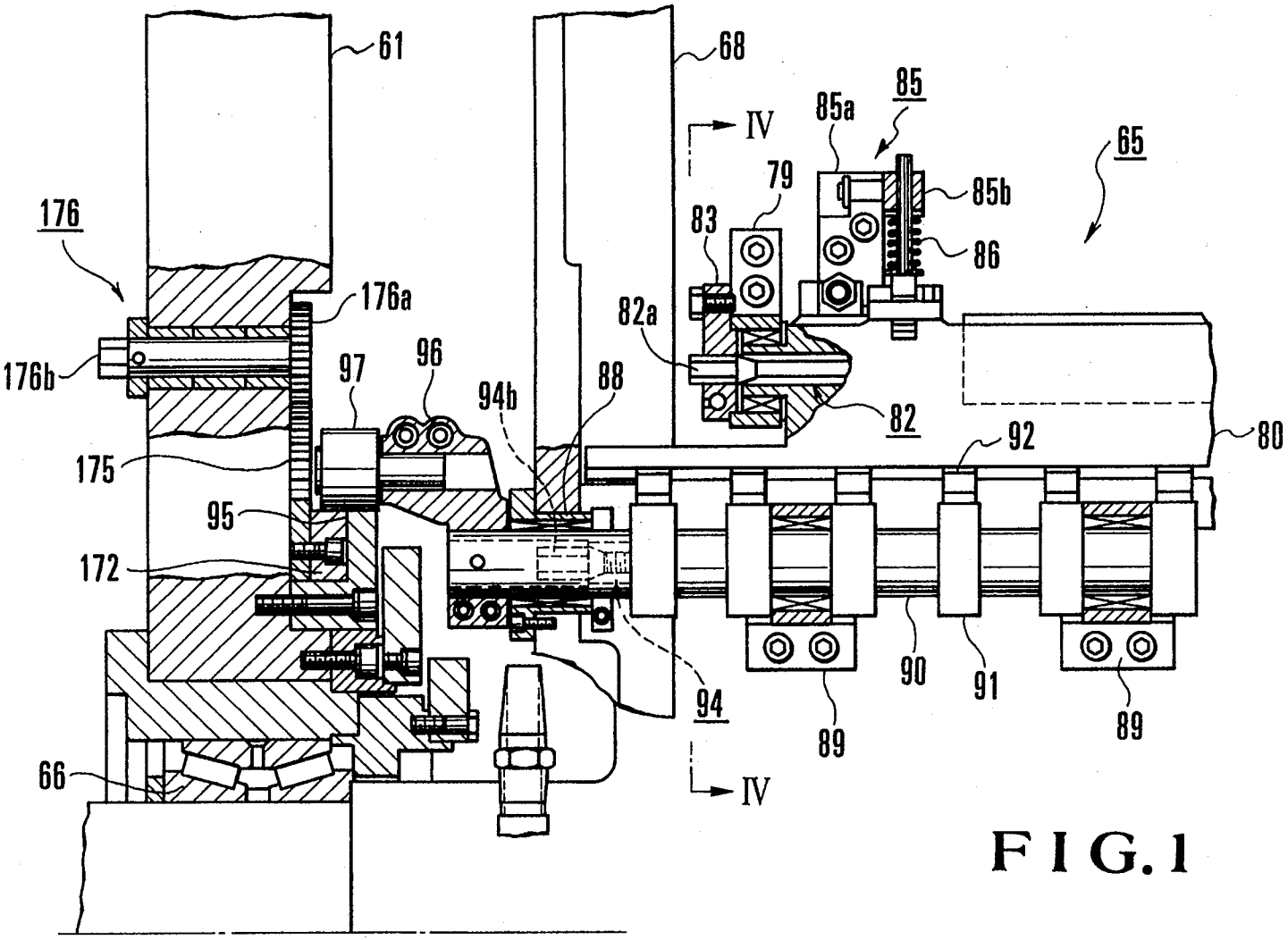
FIG. 1 is a partially cutaway front view for explaining a gripper unit, in which the left half of a reversing cylinder partially developed is shown.
Figure 2:
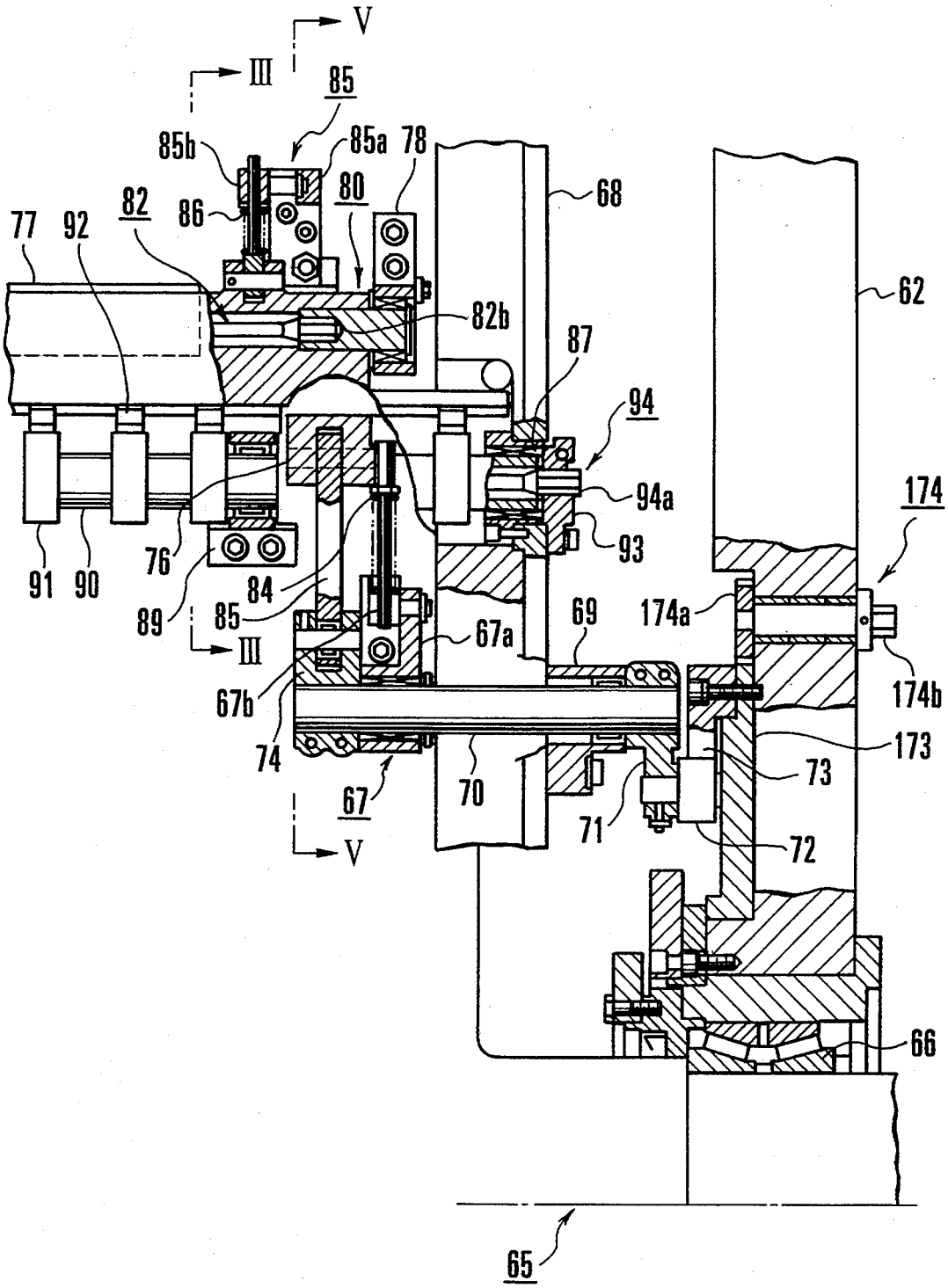
FIG. 2 is a partially cutaway front view for explaining the gripper unit, in which the right half of the reversing cylinder partially developed is shown.
Figure 3:
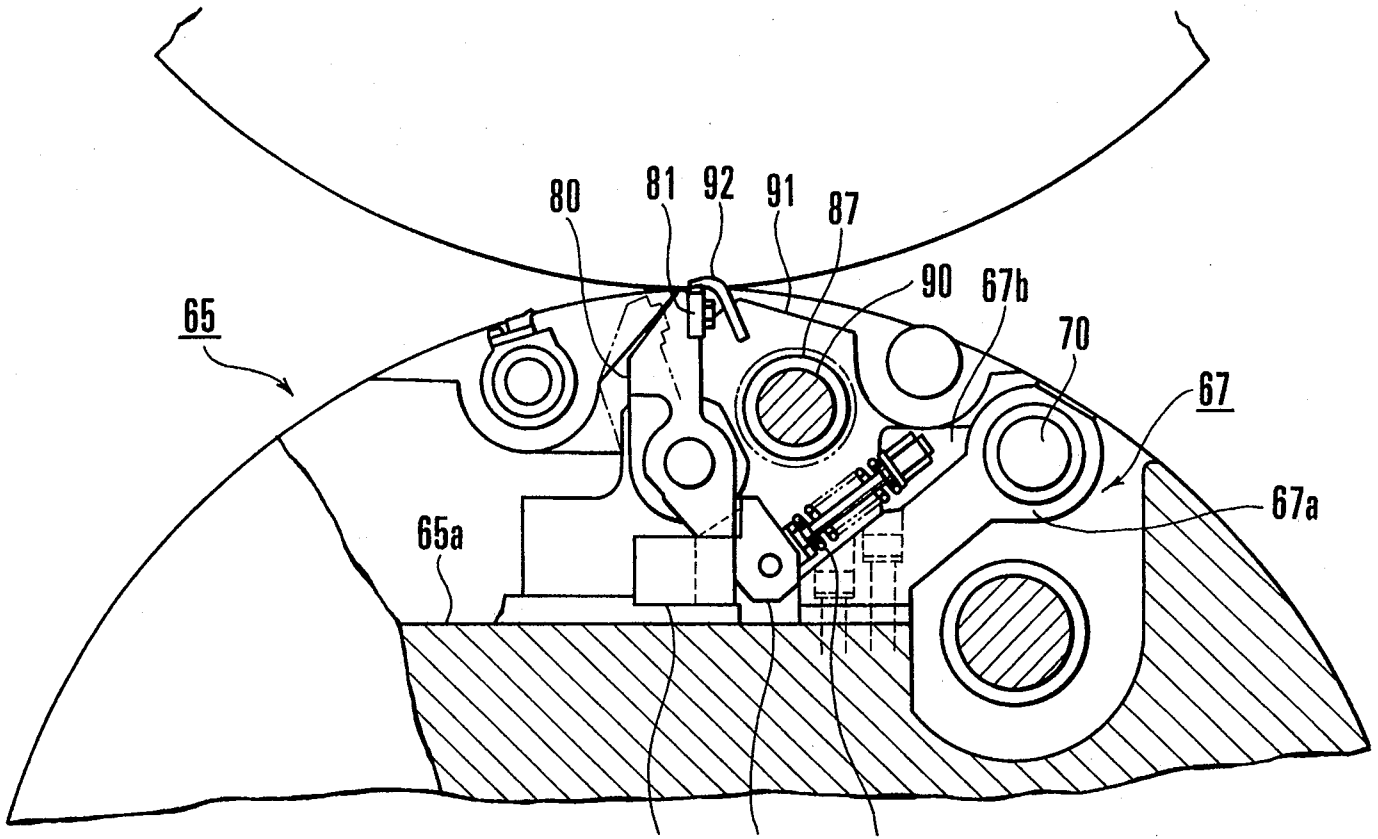
FIG. 3 is a sectional view taken along a line III–III in FIG. 2.
Figure 4:
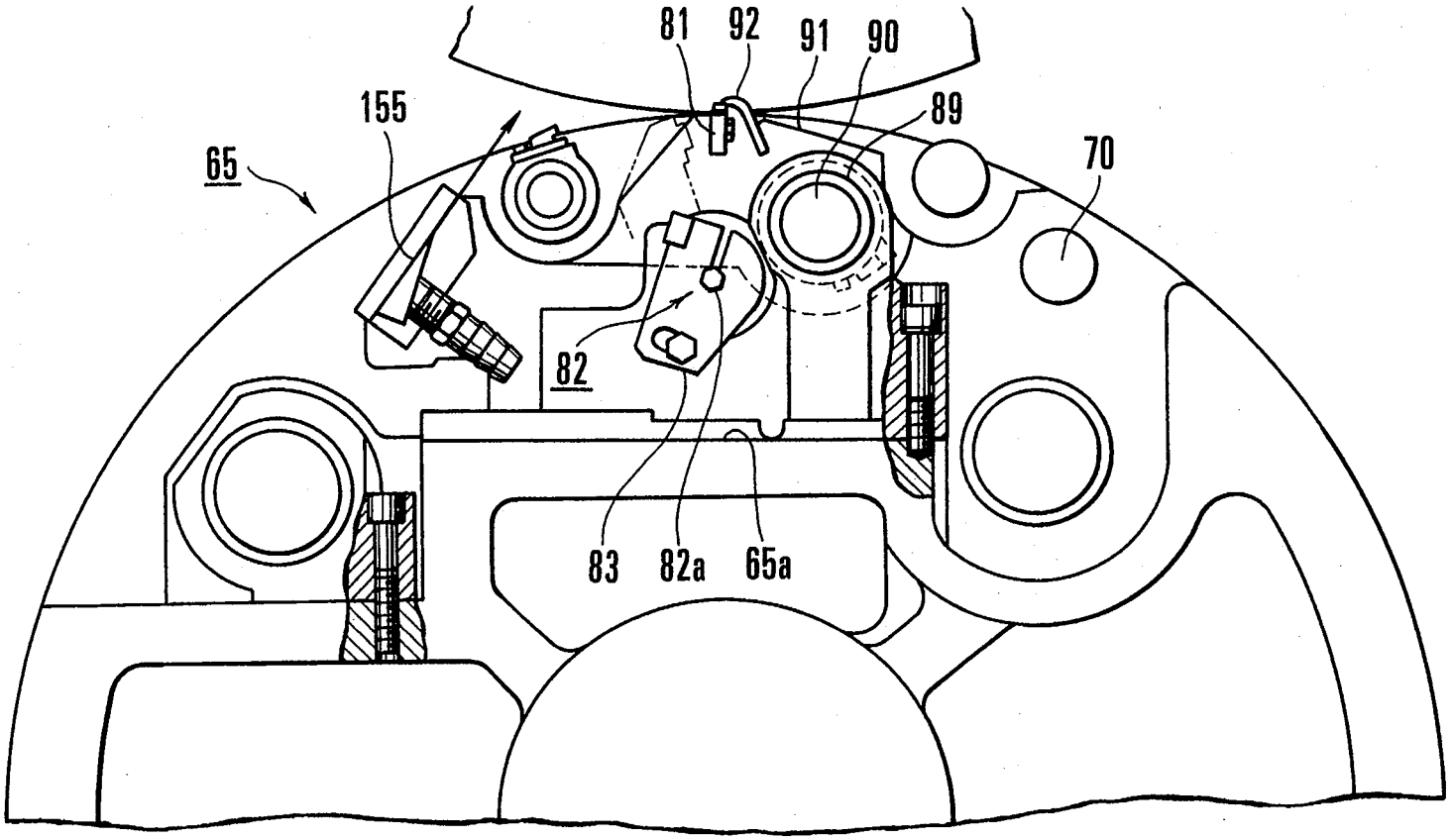
FIG. 4 is a sectional view taken along a line IV–IV in FIG. 1.
Figure 5:
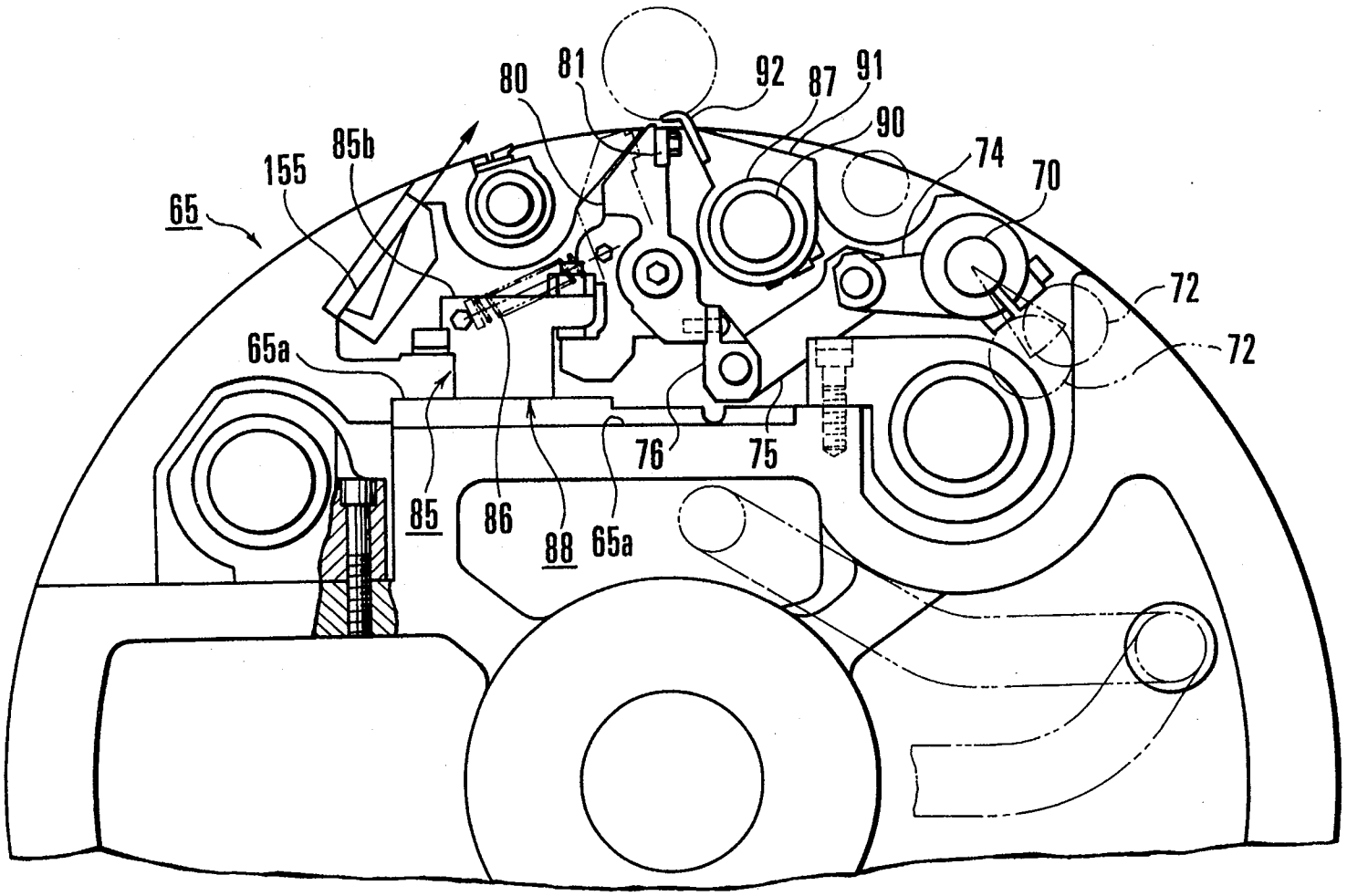
FIG. 5 is a sectional view taken along a line V–V in FIG. 2.
Figure 6:
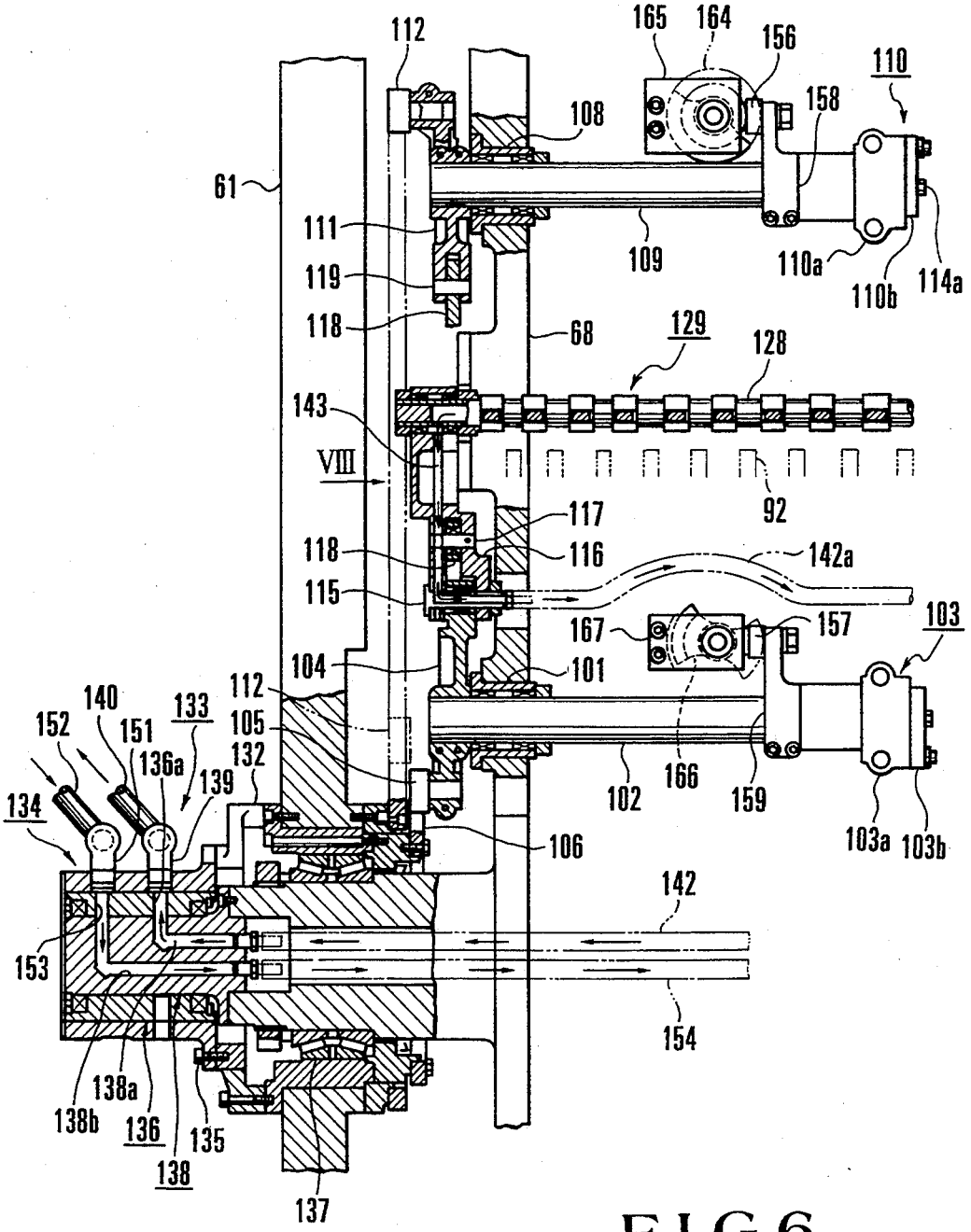
FIG. 6 is a partially cutaway front view for explaining a sucker portion, in which the left half of the reversing cylinder partially developed is shown.
Figure 7:
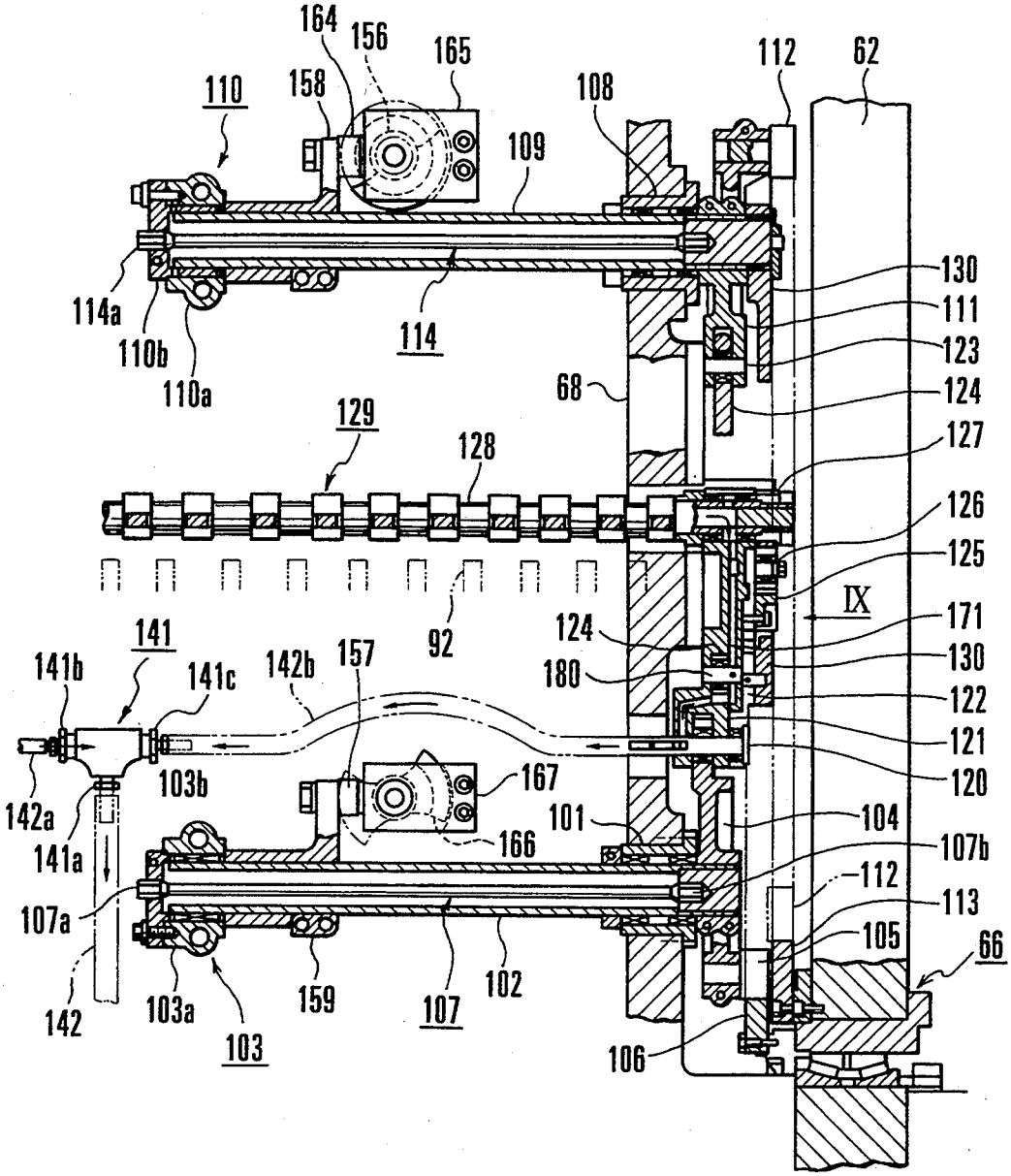
FIG. 7 is a partially cutaway front view for explaining the sucker portion, in which the right half of the reversing cylinder partially developed is shown.
Figure 8:
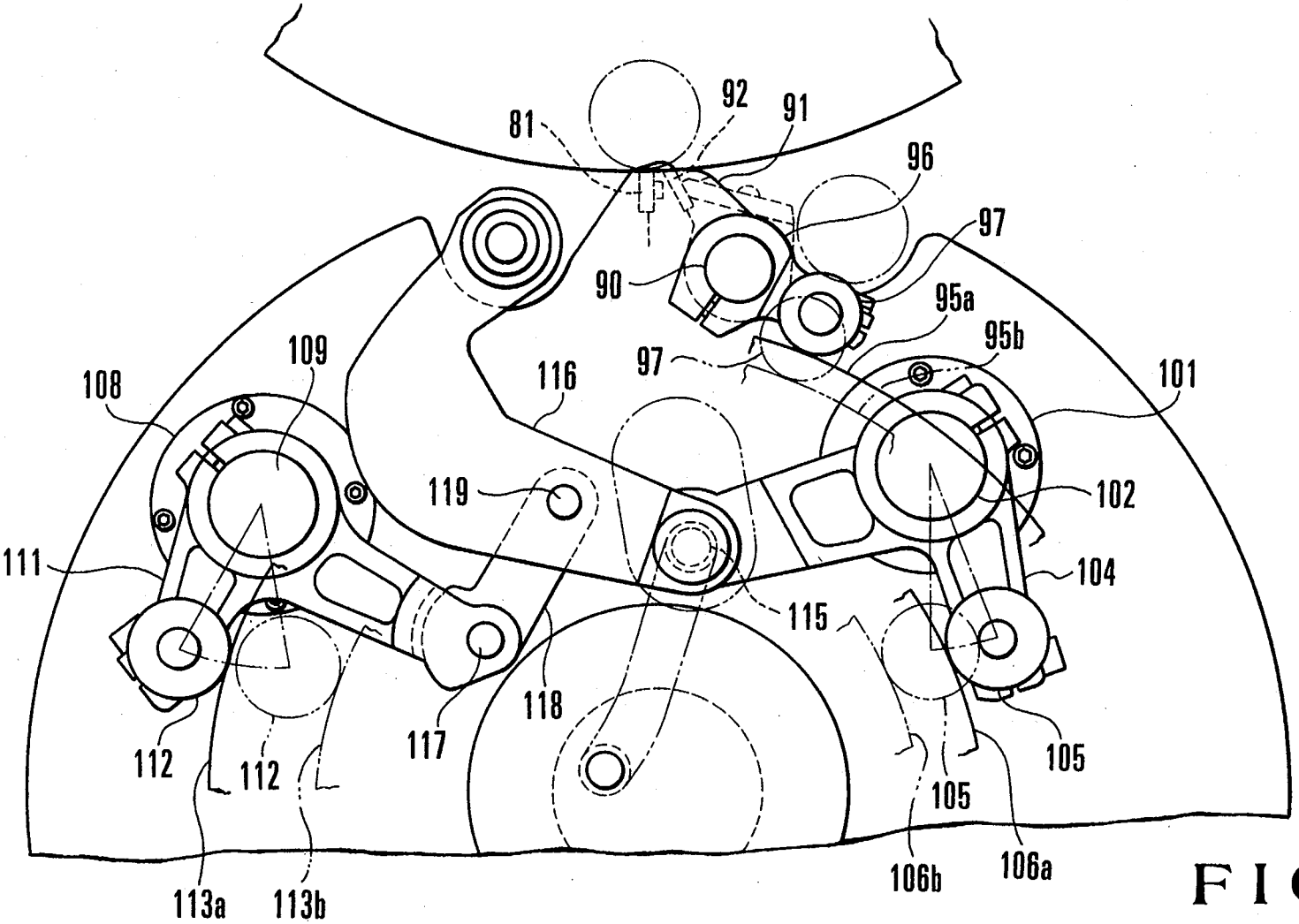
FIG. 8 is a side view viewed from a direction indicated by an arrow VIII in FIG. 6.
Figure 9:
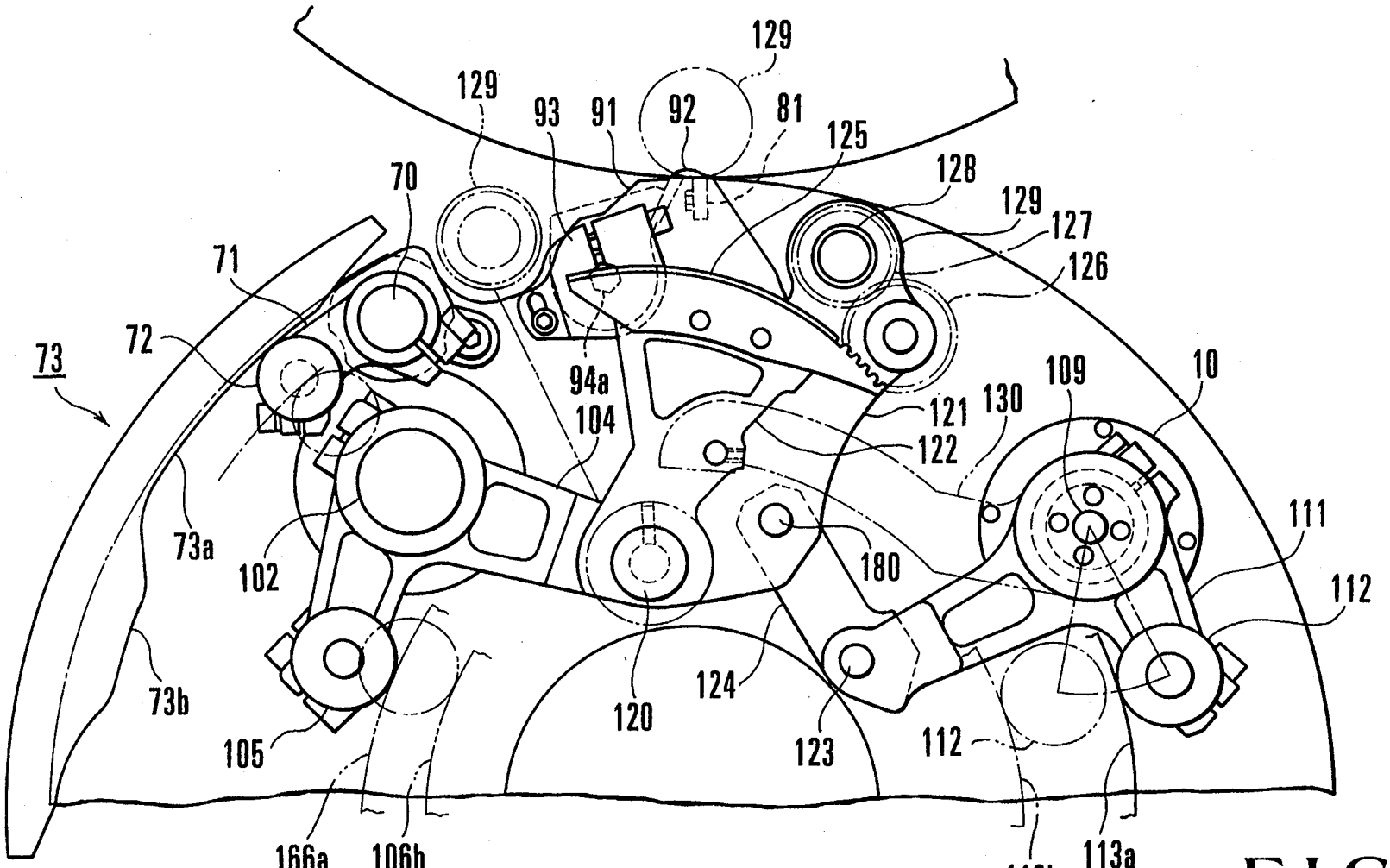
FIG. 9 is a side view viewed from a direction indicated by an arrow IX in FIG. 7.
Figure 10:
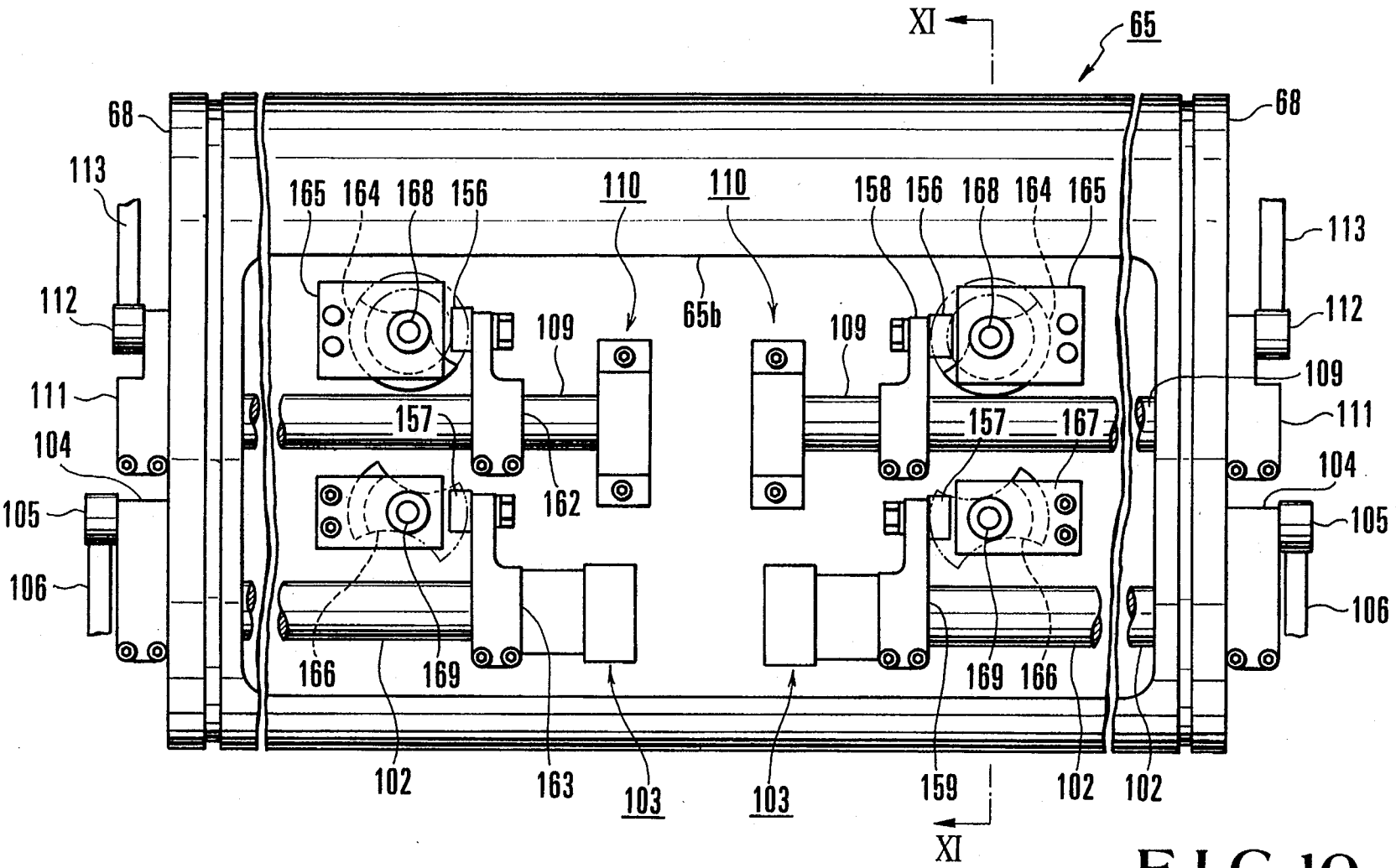
FIG. 10 is a plan view showing a gap of the reversing cylinder in which drive shafts of suckers are stored.
Figure 11:
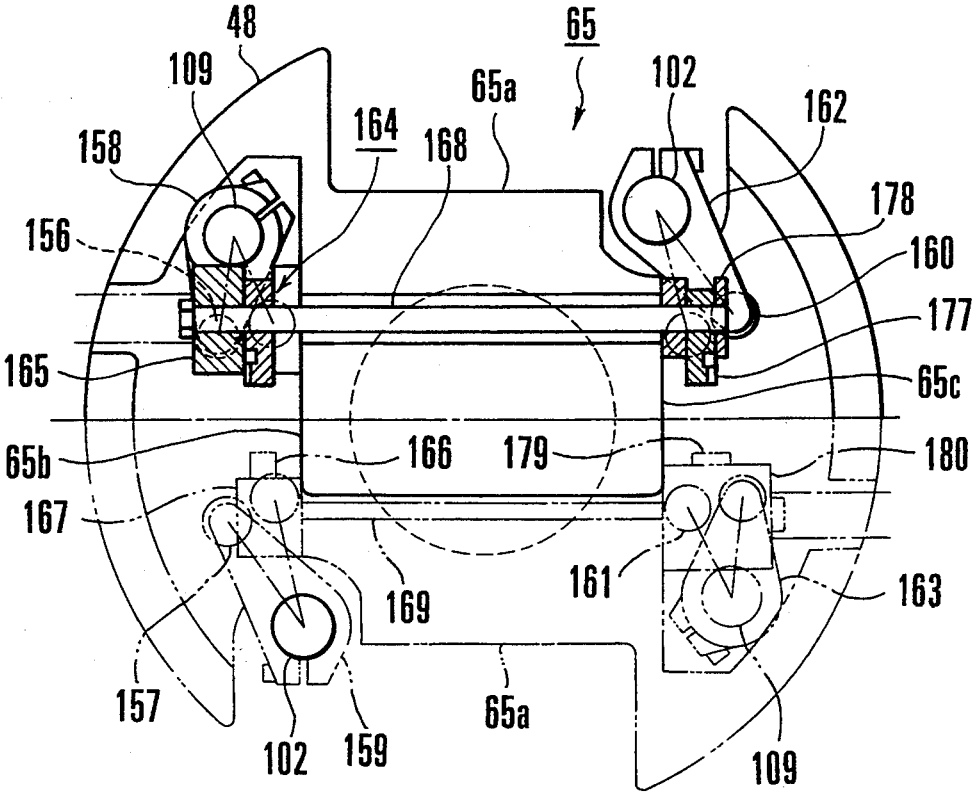
FIG. 11 is a side view viewed from a direction indicated by an arrow XI in FIG. 10.
Figure 12:
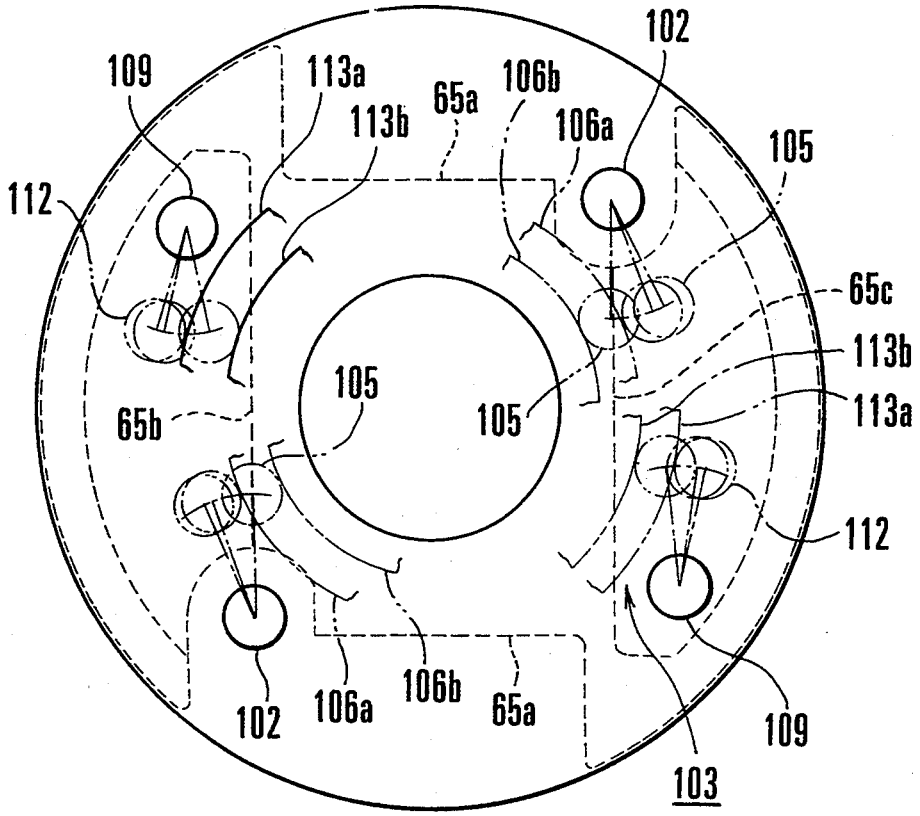
FIG. 12 is a side view showing the reversing cylinder, which explains the operation of a paper holding cam mechanism.
Figure 13:
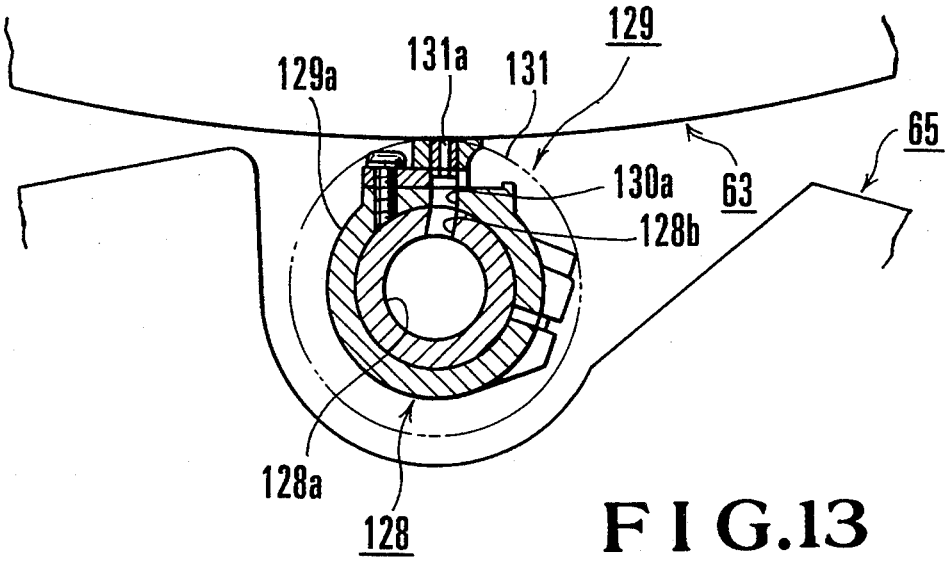
FIG. 13 is a sectional view showing a sucker.
Figure 14:
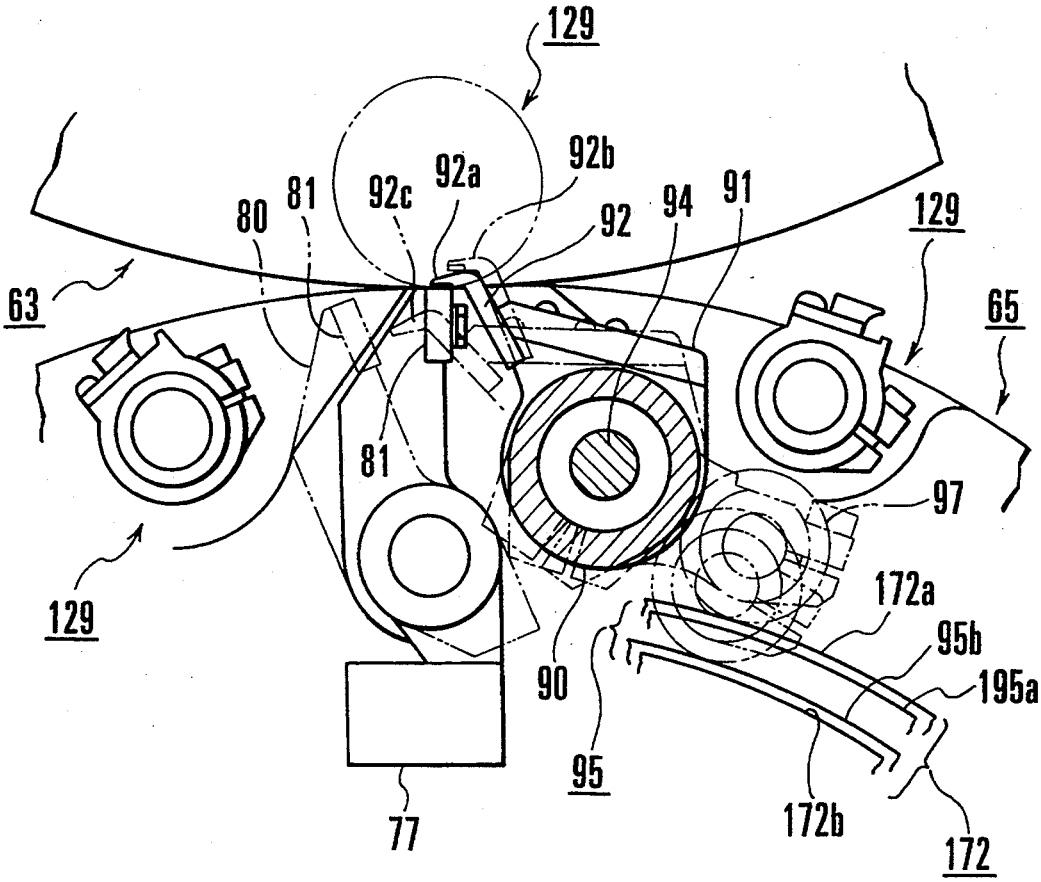
FIG. 14 is a front view showing a gripper, a gripper pad, and the sucker, which explains the gripping operation of a paper sheet.
Figure 15:
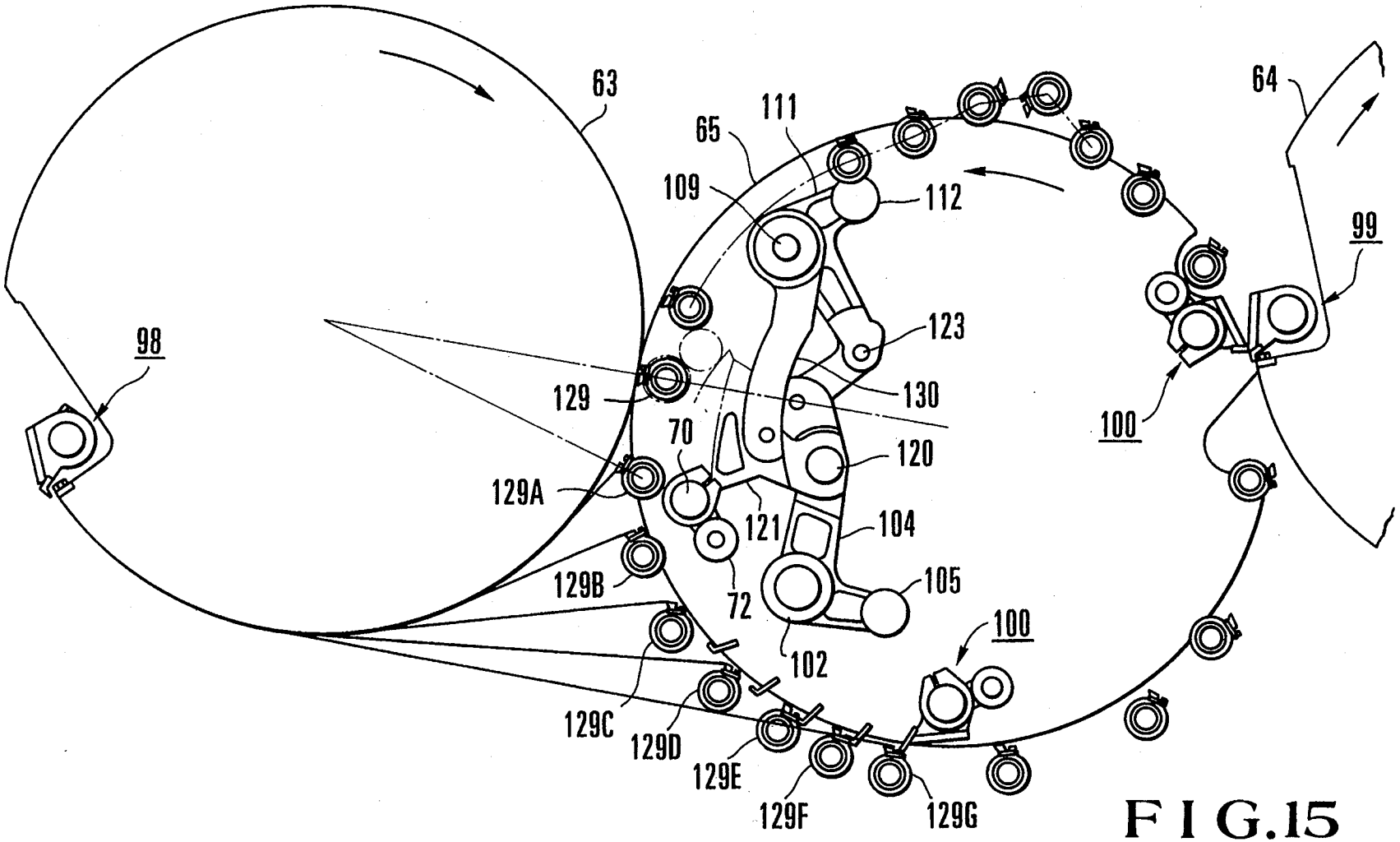
FIG. 15 is a side view showing a portion near the reversing cylinder, which explains the operations of the sucker and a reversing gripper unit.
Figure 16:
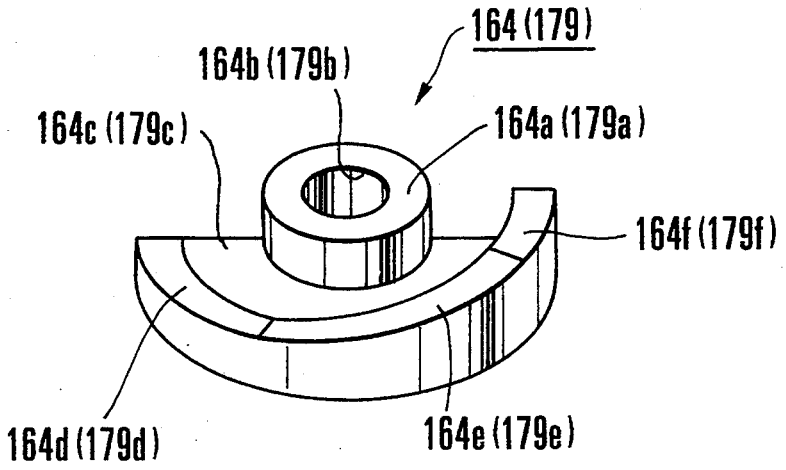
FIG. 16 is a perspective view showing a stop cam.
Figure 17:
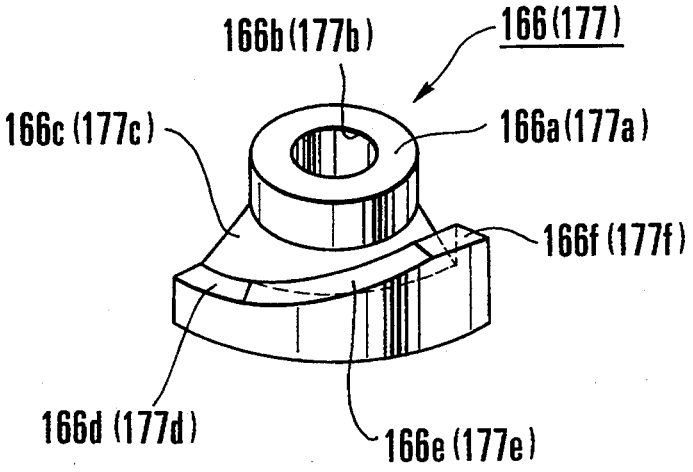
FIG. 17 is a perspective view showing another stop cam.
Figure 18:
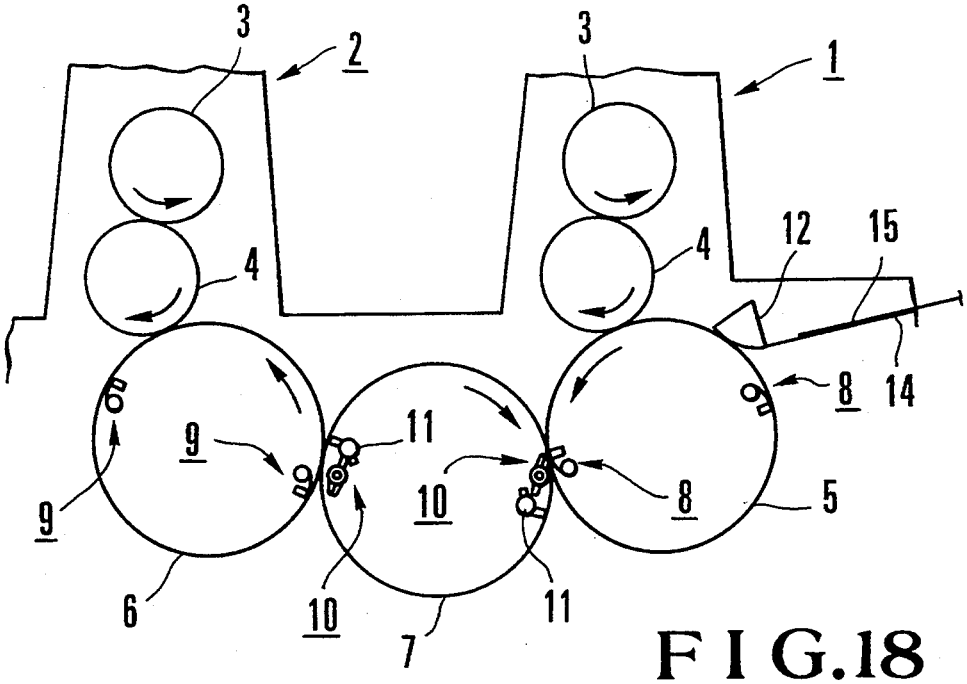
FIG.18 PRIOR ART
FIG. 18 is a view showing a cylinder arrangement in a conventional sheet-fed rotary press with a reversing mechanism.
Figure 19:
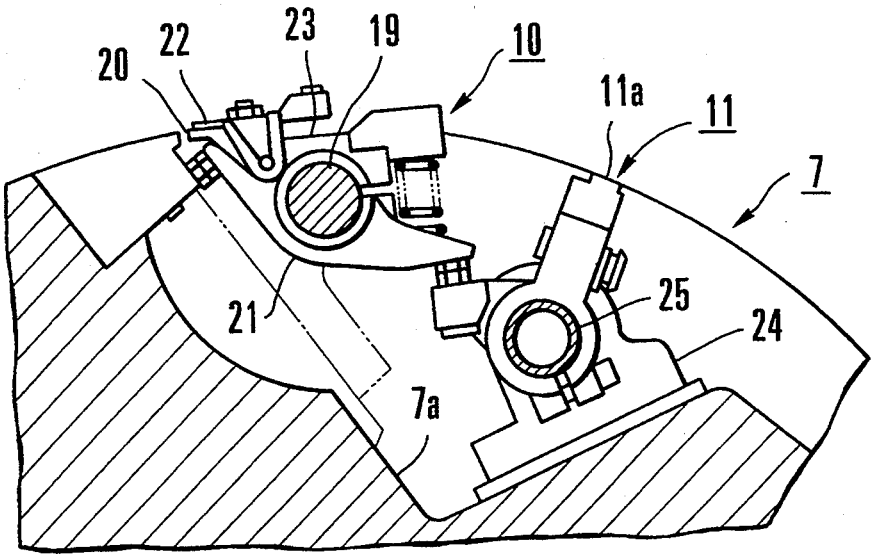
FIG.19 PRIOR ART
FIG. 19 is an enlarged sectional view showing a paper holding unit and a paper trailing end holding unit of the conventional sheet-fed rotary press with the reversing mechanism.
Figure 20:
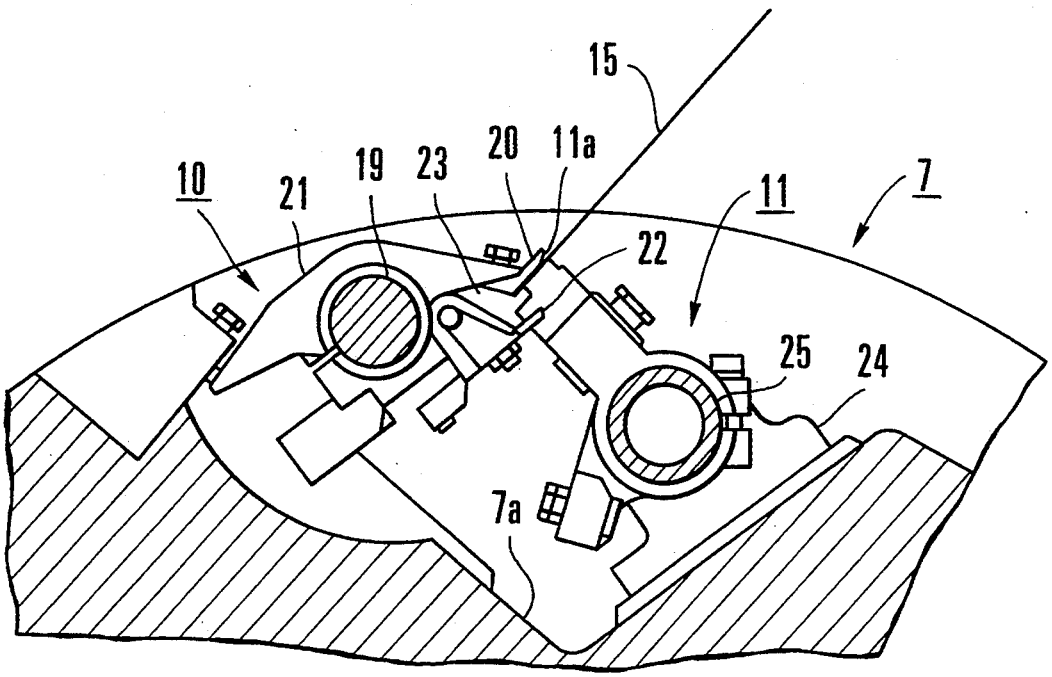
FIG.20 PRIOR ART
FIG. 20 is an enlarged sectional view corresponding to FIG. 19 and showing the paper holding unit and the paper trailing end holding unit in a state wherein the paper trailing end holding unit holds the trailing end of a paper sheet to transfer the paper sheet to the paper holding unit.
Figure 21:
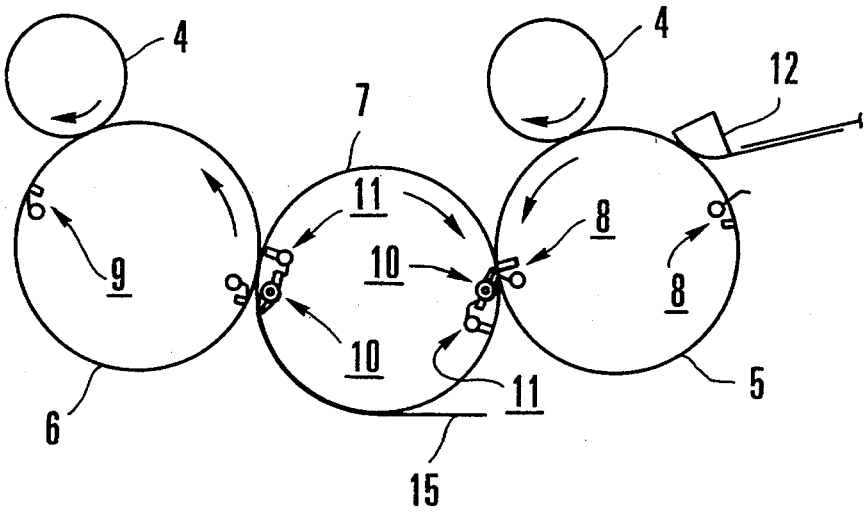
FIG.21 PRIOR ART
FIG. 21 is a view showing the cylinder arrangement, which explains the single-sided printing operation of the conventional sheet-fed rotary press with the reversing mechanism.
Figure 22:
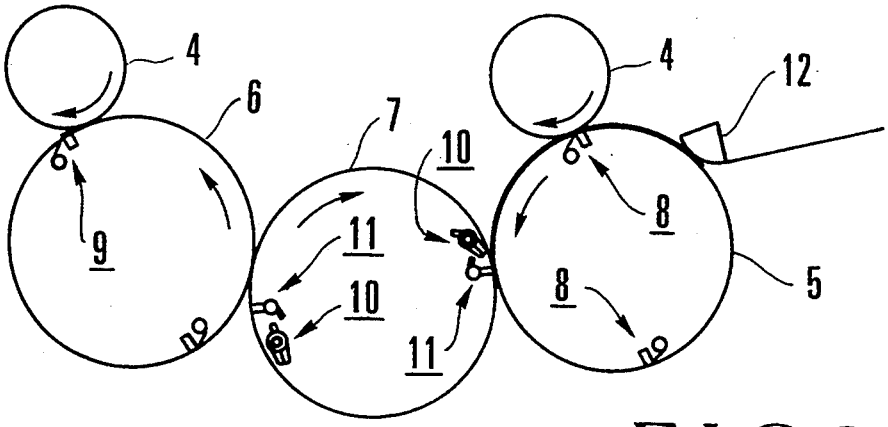
FIG.22 PRIOR ART
FIG. 22 is a view showing the cylinder arrangement, which explains the perfecting printing operation of the conventional sheet-fed rotary press with the reversing mechanism.
Figure 23:
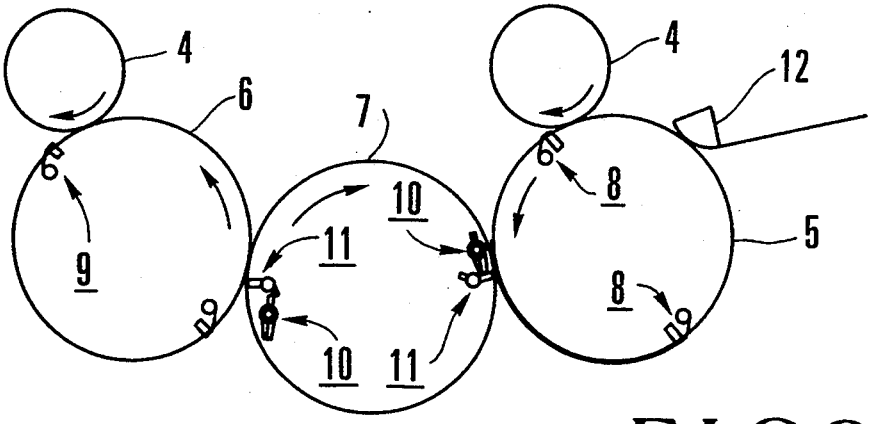
FIG.23 PRIOR ART
FIG. 23 is a view showing the cylinder arrangement, which explains the perfecting printing operation of the conventional sheet-fed rotary press with the reversing mechanism.
Figure 24:
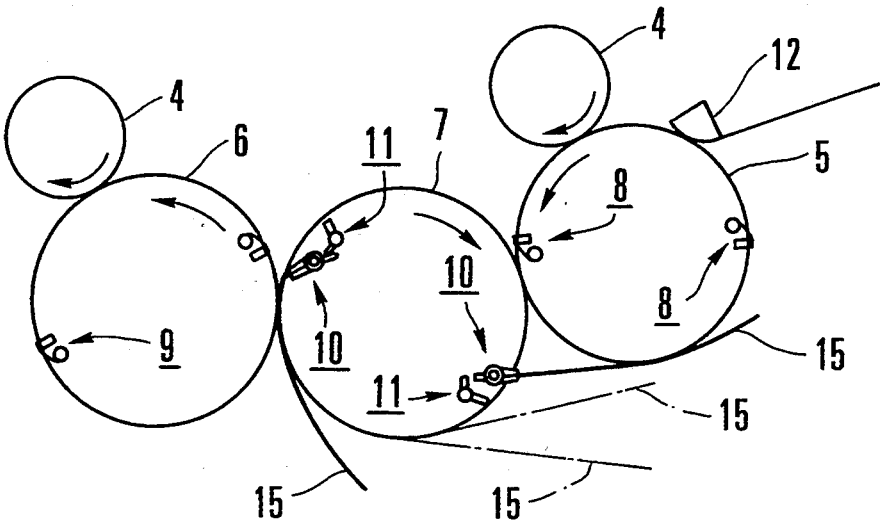
FIG.24 PRIOR ART
FIG. 24 is a view showing the cylinder arrangement, which explains the perfecting printing operation of the conventional sheet-fed rotary press with the reversing mechanism.

FIGS. 1 to 17 show a sheet-fed rotary press with a reversing mechanism according to an embodiment of the present invention. FIG. 1 shows the left half of a reversing cylinder partially developed to explain a gripper unit. FIG. 2 shows the right half of the reversing cylinder partially developed to explain the gripper unit. FIG. 3 shows a section taken along a line III—III in FIG. 2. FIG. 4 shows a section taken along a line IV—IV in FIG. 1. FIG. 5 shows a section taken along a line V—V in FIG. 2. FIG. 6 shows the left half of the reversing cylinder partially developed to explain a sucker portion. FIG. 7 shows the right half of the reversing cylinder partially developed to explain the sucker portion. FIG. 8 shows a side surface viewed from a direction indicated by an arrow VIII in FIG. 6. FIG. 9 shows a side surface viewed from a direction indicated by an arrow IX in FIG. 7. FIG. 10 shows a gap portion of the reversing cylinder in which the drive shafts of suckers are stored. FIG. 11 shows a section taken along a line XI—XI in FIG. 10. FIG. 12 shows the reversing cylinder to explain the operation of a cam mechanism for driving a paper trailing end holding member. FIG. 13 shows a sucker. FIG. 14 shows the gripper unit and the sucker portion to explain the gripping operation of a paper sheet. FIG. 15 shows a portion near the reversing cylinder to explain the operations of the sucker and a reversing gripper unit. FIGS. 16 and 17 show stop cams.

As shown in FIG. 15, a first double-diameter impression cylinder 63 as an upstream cylinder with respect to the rotation direction of the cylinder indicated by an arrow, i.e., a paper convey direction, and a second double-diameter impression cylinder 64 as a downstream cylinder are axially rotatably supported by left and right frames 61 and 62 at two end shafts. A double-diameter reversing cylinder 65 as a paper convey cylinder having its outer surface pressed against the cylinders 63 and 64 is axially rotatably supported between the impression cylinders 63 and 64 through antifriction bearings 66, as shown in FIGS. 1 and 2. Gaps 65*a* shown in FIGS. 3 to 5 are formed in the circumference of the reversing cylinder 65 by almost the overall length of the cylinder. The pair of gaps 65*a* are provided to store gripper units arranged at positions which divide the circumference of the reversing cylinder 65 into halves.

Referring to FIGS. 1 and 2, a drive shaft bracket 67 having a fixed portion 67*a* and a pivot portion 67*b* pivotally mounted on the fixed portion 67*a* is fixed on the bottom surface of each gap 65*a*. A bracket 69 is fixed outside one of bearers 68 for closing the gaps 65*a*. Two end portions of a drive shaft 70 extending through one of the bearers 68 are axially pivotally supported by the fixed portion 67*a* of the drive shaft 67 and the bracket 69.

The proximal portion of a lever 71 and a free end portion to which a cam follower 72 is mounted is fixed to one end of the drive shaft 70 on the bracket 69 side. As shown in FIG. 9, the cam follower 72 of the lever 71 is in contact with a cam surface having a large-diameter portion 73*a* and a small-diameter portion 73*b* of a gripper pad moving cam 73. The gripper pad moving cam 73 is fixed to a gear 173 pivotally supported on the frame 62 side to constitute a gripper pad moving means.

A pin 174 has one end with a gear 174*a* engaged with the gear 173 and is pivotally supported by the frame 62. When a wrench is engaged with a hexagon head 174*b* provided to the other end of the pin 174 to pivot the pin 174, the gripper pad moving cam 73 is pivoted together with the gear 173 through the gear 174*a* and freely moves between predetermined positions for perfecting and single-sided printing operations.

A drive lever 74 is fixed at the other end of the drive shaft 70 to be adjacent to the drive shaft bracket 67. One end of a drive rod 75 is pivotally mounted at the free end portion of the drive lever 74. A coupling lever 76 is pivotally mounted at the other end of the drive rod 75.

An elongated stop bar 77 serving as a regulating member having a rectangular section and extending along the axial direction of the reversing cylinder 65 is fixed on the bottom surface of the gap 65*a*, as shown in FIG. 3. The stop bar 77 is located on the line of pressing action of grippers 92 (to be described later) with respect to gripper pads 81 (to be described later). In addition, a pair of left and right brackets 78 and 79 are fixed on the bottom surface of the gap 65*a* to be adjacent to the bearers 68.

A gripper pad bar 80 having a through hole extending along the axial direction is axially pivotally supported by the pair of brackets 78 and 79 at its two end shafts through antifriction bearings to be freely swung. A plurality of gripper pads 81 serving as gripper pad members are parallelly arranged at one swinging end portion, i.e., an edge portion of the gripper pad bar 80 in correspondence with the grippers 92.

A torsion bar 82 is inserted through the inner hole of the gripper pad bar 80. As shown in FIG. 4, one hexagon head 82*a* of the torsion bar 82 is fitted in the hexagon socket of a torsion bar holder 83 which is fixed to the bracket 79 and pivotally moves in the circumferential direction, thereby fixing one end of the torsion bar 82. The other hexagon head 82*b* of the torsion bar 82 is fitted in a hexagon socket formed in the other end of the gripper pad bar 80 which is free to pivot.

As a result, as shown in FIG. 3, the gripper pad bar 80 is brought into contact with the stop bar 77 by a torsion spring force accumulated in the torsion bar 82, thereby regulating a pivotal movement limit in a direction to press the cam follower 72 against the cam surface of the gripper pad moving cam 73.

A compression coil spring 84 is interposed between the pivot portion 67*b* of the drive shaft bracket 67 and the coupling lever 76. The compression coil spring 84 biases the cam follower 72 in the same direction as the biasing direction of the torsion spring force of the torsion bar 82, i.e., in a direction to press the cam follower 72 against the cam surface of the gripper pad moving cam 73.

A pair of left and right holders 85 each having a fixed portion 85*a* and a pivot portion 85*b* pivotally mounted on the fixed portion 85*a* are fixed on the bottom surface of the gap 65*a*. A compression coil spring 86 is interposed between each pivot portion 85*b* and the gripper pad bar 80. The compression coil spring 86 biases the cam follower 72 in a direction to press the cam follower 72 against the cam surface of the gripper pad moving cam 73.

With the above structure, in a state wherein the cam follower 72 of the reversing cylinder 65 is pressed against the cam surface of the griper pad moving cam 73 of the frame 62, the reversing cylinder 65 is rotated to pivot the cam follower 72. At this time, the gripper pad bar 80 is swung at a predetermined timing by cooperation of the level of the cam surface and the spring forces of the compression coil springs 84 and 86 and the torsion bar 82. The gripper pads 81 move between an operating position at which the outer surface of the reversing cylinder 65 and the distal ends of the gripper pads 81 are aligned on the same plane, as indicated by a solid line in FIG. 14, and a retreat position at which the distal ends of the gripper pads 81 retreat from the outer surface of the reversing cylinder 65, as indicated by a chain line in FIG. 14.

The grippers 92 constituting the gripper unit together with the corresponding gripper pads 81 and the moving unit for the grippers 92 will be described below.. A pair of bearings 87 and 88 are located obliquely below the gripper pads 81 and respectively fitted in the bearing holes of the left and right bearers 68. A plurality of bearings 89 are aligned between the bearings 87 and 88 along the axial direction of the reversing cylinder 65 and fixed on the bottom surface of the gap 65*a*. A gripper shaft 90 is axially pivotally supported between the pair of bearings 87 and 88 and the plurality of bearings 89. A plurality of gripper holders 91 aligned along the axial direction are fixed to the gripper shaft 90 at a predetermined interval. The grippers 92 serving as gripper members for gripping a paper sheet with the gripper pads 81 are fixed at the distal ends of the corresponding gripper holders 91.

A torsion bar holder 93 is fixed to one of the bearers 68 to be free to pivot in the circumferential direction. As shown in FIG. 9, a hexagon head 94*a* formed at one end of a torsion bar 94 extending through the inner hole of the gripper shaft 90 is fitted in the hexagon socket of the torsion bar holder 93. A hexagon head 94*b* formed at the other end of the torsion bar 94 is fitted in a hexagon socket formed in one end of the gripper shaft 90.

As shown in FIGS. 8 and 14, a gripper closing cam 95 serving as a gripper closing unit having a cam surface comprising a large-diameter portion 95*a* and a small-diameter portion 95*b* is fixed to the frame 61. As shown in FIG. 1, a cam follower 97 is pivotally mounted at the free end portion of a lever 96 fixed at the end portion of the gripper shaft 90. The cam follower 97 is pressed against the cam surface of the gripper closing cam 95 by ½ the width by the torsion spring force of the torsion bar 94.

As shown in FIGS. 1 and 14, a gripper moving cam 172 serving as a gripper moving unit having a cam surface comprising a large-diameter portion 172*a* and a small-diameter portion 172*b* is pivotally supported by the boss portion of the gripper closing cam 95. The gripper moving cam 172 is bolted to a gear 175 pivotally supported by the boss portion of the gripper closing cam 95 to be integrally pivoted with the gear 175.

A pin 176 having a hexagon head 176*b* formed at one end is pivotally supported by the frame 61. A gear 176*a* meshed with the gear 175 is fixed at the other end of the pin 176.

As shown in FIG. 14, the large-diameter portion 172*a* of the gripper moving cam 172 has a larger diameter than that of the large-diameter portion 95*a* of the gripper closing cam 95. The small-diameter portion 172*b* of the gripper moving cam 172 has a smaller diameter than that of the small-diameter portion 95*b* of the gripper closing cam 95. The cam follower 97 of the above-described lever 96 is pressed against the cam surface of the large-diameter portion 172*a* of the gripper moving cam 172 by the remaining ½ width by the torsion spring force of the torsion bar 94.

With the above structure, when the reversing cylinder 65 is rotated, and the cam follower 97 is opposing the small-diameter portion 172*b* of the gripper moving cam 172, the cam follower 97 is pivoted while being pressed against the cam surface of the small-diameter portion 95*b* of the gripper closing cam 95. For this reason, the gripper holders 91 are swung together with the grippers 92 by cooperation of the levels of the cam surfaces and the torsion spring force of the torsion bar 94. With this operation, the grippers 92 move between a closing position at which the grippers 92 grip a paper sheet, as indicated by reference numeral 92*a* in FIG. 14, and a position at which the grippers 92 release the paper sheet, as indicated by reference numeral 92*b*. In this manner, the grippers 92 are opened and closed at the two positions to grip a paper sheet.

From this state, when the reversing cylinder 65 is rotated to cause the cam follower 97 to oppose the large-diameter portion 172*a* of the gripper moving cam 172, the cam follower 97 is separated from the cam surface of the gripper closing cam 95 and pivoted while being pressed against the cam surface of the large-diameter portion 172*a* of the gripper moving cam 172. For this reason, the gripper holders 91 are pivoted together with the grippers 92 against the torsion spring force of the torsion bar 94. The grippers 92 move from the operating positions 92*a* and 92*b* shown in FIG. 14 to a retreat position at which the grippers 92 retreat from the outer surface of the reversing cylinder 65, as indicated by reference numeral 92*c*.

When a wrench is engaged with the hexagon head 176*b* to pivot the pin 176, the gear 175 is pivoted through the gear 176*a*. With this operation, the gripper moving cam 172 is pivoted between a position corresponding to a perfecting printing operation and a position corresponding to a single-sided printing operation.

Referring to FIG. 15, gripper units 98 and 99 each having grippers and gripper pads are provided to the impression cylinders 63 and 64, respectively, in gaps at positions which divide the circumferences of the impression cylinders 63 and 64 into halves. The gripper units of the reversing cylinder 65, each of which has grippers and gripper pads, are called reversing gripper units 100.

A paper trailing end holding unit and rotating and moving units for the holding unit will be described below. As shown in FIGS. 10 to 12, a pair of gaps 65*b* and 65*c* for storing the drive shafts of the suckers are formed between the pair of gaps 65*a* provided at positions which divide the circumference of the reversing cylinder 65 into halves. The ceilings of the gaps 65*b* and 65*c* constitute the circumference of the reversing cylinder 65. Referring to FIGS. 6 and 7, a lever drive shaft 102 extends through each of the gaps 65*b* and 65*c* of the reversing cylinder 65 in a direction of width of the machine frame, i.e., in the axial direction of the reversing cylinder 65 and is divided into two portions at the central portion. One end of the divided lever drive shaft 102 is axially pivotally supported by an antifriction bearing 101 fitted in the bearer 68. The other end of the lever drive shaft 102 is axially pivotally supported by a main body 103*a* of a torsion bar holder 103 which is fixed on the bottom surface of each of the gaps 65*b* and 65*c* at the central portion of the reversing cylinder 65 along the axial direction.

An L-shaped lever 104 is fixed by split-clamping at the projecting portion of each lever drive shaft 102, which externally projects from the bearer 68, as shown in FIG. 8. A cam follower 105 pivotally mounted at one free end portion of the lever 104 is in contact with the outer cam surface of a corresponding cam 106 fixed to the frame 61 or 62 side. The outer cam surface of the cam 106 comprises a large-diameter portion 106*a* and a small-diameter portion 106*b*.

A lid 103*b* is fixed to the main body 103*a* of the torsion bar holder 103 to be free to pivot in the circumferential direction. A hexagon head 107*a* formed at one end of a torsion bar 107 extending through the inner hole of the lever drive shaft 102 is fitted and fixed in the hexagon socket of the lid 103*b*. A hexagon head 107*b* formed at the other end of the torsion bar 107 is fitted in a hexagon socket formed in one end of the lever drive shaft 102.

With the above structure, when the lid 103*b* of the torsion bar holder 103 is fixed in a state wherein a torsion spring force is accumulated in the torsion bar 107, the cam follower 105 is pressed against the cam surface of the cam 106. Upon a pivotal movement of the reversing cylinder 65, the lever 104 is swung at a predetermined timing by cooperation of the level of the cam surface of the cam 106 and the spring force of the torsion bar 107.

An antifriction bearing 108 is fitted in the bearing hole of each bearer 68 of the reversing cylinder 65. A tubular lever drive shaft 109 extends in each of the gaps 65*b* and 65*c* of the reversing cylinder 65 along the direction of width of the machine frame and is divided into two portions at the central portion. One end of the divided lever drive shaft 109 is axially pivotally supported by the antifriction bearing 108. The other end of the lever drive shaft 109 is axially pivotally supported by a main body 110*a* of a torsion bar holder 110 fixed on the bottom surface of each of the gaps 65*b* and 65*c* at the central portion of the reversing cylinder 65 along the axial direction.

As shown in FIG. 8, an L-shaped lever 111 is fixed by split-clamping at the projecting portion of the lever drive shaft 109, which externally projects from the bearer 68. A cam follower 112 pivotally mounted at one free end portion of the lever 111 is in contact with the outer cam surface of a corresponding cam 113 fixed on the frame 61 or 62 side. The outer cam surface of the cam 113 comprises a large-diameter portion 113*a* and a small-diameter portion 113*b*.

A lid 110*b* is fixed to the main body 110*a* of the torsion bar holder 110 to be free to pivot in the circumferential direction. A hexagon head 114*a* formed at one end of a torsion bar 114 extending through the inner hole of the lever drive shaft 109 is fitted and fixed in the hexagon socket of the lid 110*b*. A hexagon head 114*b* formed at the other end of the torsion bar 114 is fitted in a hexagon socket formed in one end of the lever drive shaft 109.

With the above structure, when the lid 110*b* is fixed in a state wherein a torsion spring force is accumulated in the torsion bar 114, the cam follower 112 is pressed against the cam surface of the cam 113. Upon pivotal movement of the reversing cylinder 65, the lever 104 is swung at a predetermined timing by cooperation of the level of the cam surface of the cam 113 and the spring force of the torsion bar 114.

As shown in FIGS. 6 and 8, outside one bearer 68 of the reversing cylinder 65, an L-shaped sucker drive lever 116 is pivotally mounted at the free end portion of the lever 104 by a coupling pin 115. One end of a coupling link 118 having the other end pivotally mounted at the free end portion of the lever 111 by a pin 119 is pivotally mounted at a portion near the proximal portion of the sucker drive lever 116.

As shown in FIGS. 7 and 9, outside the other bearer 68 of the reversing cylinder 65, a sucker drive lever 121 pivotally mounted at the free end portion of the lever 104 by a coupling pin 120 is provided to overlap a gear holder 122. One end of a coupling link 124 having the other end pivotally mounted at the free end portion of the lever 111 by a pin 123 is pivotally mounted at a portion near the proximal portion of the sucker drive lever 121 by a pin 180.

An arcuated segment gear 125 having an arc smaller than the circumference of the reversing cylinder 65 is fixed on the circumference of the gear holder 122. An intermediate gear 126 engaged with the segment gear 125 is pivotally mounted at the free end portion of the sucker drive lever 121.

A hollow sucker shaft 128 having two closed ends is axially pivotally supported between the free end portion of the sucker drive lever 116 provided on one bearer 68 side and the free end portion of the sucker drive lever 121 provided on the other bearer side. A gear 127 meshed with the intermediate gear 126 is fixed at the shaft end portion of the sucker shaft 128. A plurality of suckers 129 (to be described later in detail) are aligned on the sucker shaft 128, and the suckers 129 are axially phase-shifted from the grippers 92, as shown in FIGS. 6 and 7.

With the above structure, when the reversing cylinder 65 is rotated, and the levers 111 on both the sides are swung by the levels of the cams 113, the sucker drive levers 116 and 121 are swung around the coupling pins 115 and 120 through the coupling links 118 and 124, respectively. The intermediate gear 126 rolls while being meshed with the segment gear 125. When the intermediate gear 126 is meshed with the gear 127, the sucker shaft 128 and the suckers 129 reciprocate in the circumferential direction of the reversing cylinder 65 while being rotated about the axis of the sucker shaft 128.

Upon movement of the suckers 129, the levers 104 on both the sides are swung by the cams 106, and the coupling pins 115 and 120 are vertically moved in the radial direction of the reversing cylinder 65. With this operation, the sucker drive levers 116 and 121 and the segment gear 125 are integrally moved in the vertical direction together with the suckers 129 and the like. By synthesizing this movement and the circumferential movement of the reversing cylinder 65, the suckers 129 and the sucker shaft 128 are moved along an arc to go over the grippers 92 and the gripper pads 81, as indicated by solid and chain lines in FIG. 9. A gear fixing lever 130 regulates the circumferential movement of the gear holder 122. The proximal end portion of the gear fixing lever 130 is pivotally supported on the lever drive shaft 109 side, and the free end portion is pivotally mounted on the gear holder 122.

The structure of the suckers 129 and an air suction unit for the suckers 129 will be described below. Referring to FIG. 13, the sucker 129 is constituted by a sucker holder 129*a* fixed to the hollow sucker shaft 128 by split-clamping and a sucker main body 131 fixed to the sucker holder 129*a*. A suction port 131*a* is formed in the sucker main body 131 while communicating with an inner hole 128*a* of the sucker shaft 128 through air holes 128*b* and 130*a*.

Referring to FIG. 6, a bracket 132 is fixed on the outer surface of the frame 61. The flange portion of a cylindrical outer cylinder 134 is fixed to the bracket 132 by a bolt 135 to support a rotary valve 133. The rotary valve 133 is constituted by the outer cylinder 134, an inner cylinder 136 fitted and fixed in the outer cylinder 134, and a rotating shaft 138 axially pivotally supported through the inner cylinder 134 and formed at the end face of an end shaft 137 of the reversing cylinder 65 to be concentric with the end shaft 137.

A nipple 139 is threadably engaged with the screw hole of the outer cylinder 134. The nipple 139 is coupled to the air suction side of a pump (not shown) through a hose 140 and is open to the outer surface of the inner cylinder 136. An elongated hole 136*a* is formed in the inner cylinder 136 to extend from the inner surface to the outer surface. The elongated hole 136*a* communicates with an L-shaped air passage 138*a* provided to the rotating shaft 138 integrally arranged with the reversing cylinder 65.

Referring to FIG. 7, a T-shaped tube 141 having openings 141*a*, 141*b*, and 141*c* facing three directions is provided to the reversing cylinder 65. The opening 141*a* is coupled to the hole 138*a* shown in FIG. 6 by a hose 142. The opening 141*b* communicates with one end of the sucker shaft 128 through a hose 142*a*, the coupling pin 115, and an air passage 143 provided to the sucker drive shaft 116, as shown in FIG. 6. The opening 141*c* communicates with the other end of the sucker shaft 128 through a hose 142*b*, the coupling pin 120, and an air passage 171 provided to the sucker drive shaft 121.

With the above structure, when the reversing cylinder 65 is rotated, the elongated hole 136*a* communicates with the hole 138*a* at a predetermined timing during one revolution of the reversing cylinder 65. Air is drawn from the suckers 129, so the trailing end of a paper sheet is drawn by the suckers 129.

In the sheet-fed rotary press with a reversing mechanism having the above structure, an air spray apparatus for spraying air between a conveyed paper sheet and the outer surface of the cylinder and a printing switching apparatus for switching between single-sided printing and perfecting printing are provided. Before a description of these apparatuses, a perfecting printing operation by this printing press will be described below with reference to FIG. 15, assuming that both the impression cylinder and the reversing cylinder are double-diameter cylinders.

Referring to FIG. 15, when the printing cylinders are rotated in directions indicated by arrows, a paper sheet 150 is gripped by the gripper unit 98 of the first impression cylinder 63 having a double-diameter and serving as an upstream cylinder with respect to the paper convey direction and wound around the outer surface of the cylinder. Even after the leading end of the paper sheet 150 reaches the contact point between the cylinders 63 and 65, the paper sheet 150 is wound on the outer surface of the impression cylinder 63 without being released from the gripper unit 98.

When the trailing end of the paper sheet 150 wound in this manner reaches the contact point between the cylinders 63 and 65, i.e., when the suckers 129 come to a line connecting the center of the impression cylinder 63 and the center of the reversing cylinder 65, the reversing cylinder 65 is continuously rotated in a state wherein the air passage 138*a* of the rotating shaft 138 which is integrally rotated with the reversing cylinder 65 corresponds to the elongated hole 136*a* of the inner cylinder 136. With this operation, the suction ports 131*a* communicate with the nipple 139 through the hoses 142, 142*a*, and 142*b*, and the air passages 143 and 171. The pump draws air from the suction ports, so that the trailing end of the paper sheet 150 is drawn by the suckers 129.

When the trailing end of the paper sheet 150 is drawn by the suckers 129, the contact position of the cam follower 112 of the sucker pivoting unit is simultaneously moved from the large-diameter portion 113*a* of the cam 113 to the small-diameter portion 113*b* in accordance with rotation of the reversing cylinder 65. The sucker drive levers 116 and 121 are swung through the swinging motion of the levers 111 and the reciprocal movement of the coupling link 124. With this operation, the intermediate gear 126 rolls on the segment gear 152 while being meshed with the segment gear 125 and rotating around its axis. The gear 127 meshed with the intermediate gear 126 and the suckers 129 integrally moved with the gear 127 are also pivoted and moved toward the outer surface of the reversing cylinder 65.

When the suckers 129 are pivoted and moved along the radial direction of the reversing cylinder 65, the contact position of the cam follower 105 of the sucker moving unit is simultaneously moved from the large-diameter portion 106*a* of the cam 106 to the small-diameter portion 106*b* in accordance with rotation of the reversing cylinder 65 to swing the levers 104. With this operation, the gear holder 122, the segment gear 125, the sucker drive lever 116, the gear 127, and the like are integrally moved along the radial direction of the reversing cylinder 65 while the gear fixing lever 130 is pivoted, thereby projecting the suckers 129 from the outer surface of the reversing cylinder 65. By synthesizing this movement and the radial movement, the suckers 129 rotate clockwise around their axes as indicated by reference numerals 129A to 129G in FIG. 15, and move along the outer surface of the reversing cylinder 65.

In this case, the suction surface of the suckers 129 for holding the trailing end of a paper sheet is almost parallel to the extending direction of the paper sheet 150 separated from the outer surface of the impression cylinder 63, i.e., the tangent direction of the impression cylinder 63. For this reason, the trailing end of the paper sheet is not separated from the suction surface of the suckers 129 by a tension generated when the paper sheet 150 is brought into tight contact with the outer surface of the impression cylinder 63.

In this manner, the suckers 129 move to the position 129G while holding the trailing end of the paper sheet, thereby reversing the paper sheet 150. Until the suckers 129 reach the contact point between the cylinders 63 and 65 to draw the trailing end of the paper sheet, the gripper units 98 of the impression cylinder 63 are closed not to release the paper sheet 150. When the trailing end of the paper sheet 150 is drawn by the suckers 129, the grippers of the gripper unit 98 are simultaneously opened to release the paper sheet 150. The paper sheet 150 is in tight contact with the outer surface of the impression cylinder 63 even after the paper sheet 150 is released from the gripper units 98.

When the reversing cylinder 65 is rotated to reach the position 129G, the rotary valve acts to stop air suction from the suckers 129, thereby releasing the paper sheet 150. At the same time, the cam follower 97 moves from the small-diameter portion 95*b* of the gripper closing cam 95 to the large-diameter portion 95*a* against the torsion spring force of the torsion bar 94. The gripper holders 91 of the reversing gripper unit 100 are swung to move the grippers 92 from the position 92*b* to the position 92*a* in FIG. 14. With this operation, the paper sheet 150 released from the suckers 129 is gripped by the grippers 92 and the gripper pads 81 of the reversing gripper unit 100.

When the reversing cylinder is continuously rotated to cause the reversing gripper unit 100 to oppose the gripper unit 99 of the impression cylinder 64, the grippers of the reversing gripper unit 100 are opened, and the grippers of the gripper unit 99 are closed to grip the paper sheet 150, as described above. Printing is performed on the lower surface of the paper sheet 150 which is being gripped by the gripper unit 99 and conveyed.

After transfer of the paper sheet 150 to the reversing gripper unit 100 at the position 129G, the suckers 129 are rotated through about 90° to reach the contact point between the cylinders 64 and 65. At the same time, the suckers 129 are radially moved to retreat from the outer surface of the reversing cylinder 65, so the suckers 129 do not interfere with the outer surface of the impression cylinder 64.

When the reversing cylinder 65 is continuously rotated, the suckers 129 are moved from the contact point between the cylinders 64 and 65 to the contact point between the cylinders 65 and 63. During this movement, the suckers 129 are pivoted through about 360° by the sucker pivoting unit and moved in the circumferential direction of the reversing cylinder 65. At the same time, the suckers 129 are moved by the sucker moving unit in the radial direction of the reversing cylinder 65 to go over the reversing gripper unit 100 and project or retreat with respect to the outer surface of the reversing cylinder 65.

During such a perfecting printing operation, the reversing gripper unit 100 retreats from the outer surface of the reversing cylinder 65 not to interfere with the impression cylinder 63. More specifically, when the reversing gripper unit 100 reaches a position immediately before a line connecting the center of the impression cylinder 63 and the center of the reversing cylinder 65, the cam follower 71 moves from the large-diameter portion 73*a* of the gripper pad moving cam 73 to the small-diameter portion 73*b* against the spring forces of the compression coil springs 84 and 86 and the torsion bar 82. With this operation, the gripper pad bar 80 of the reversing gripper unit 100 is pivoted through the lever 71 with a roller, the drive shaft 70, the drive rod 75, and the coupling lever 76 to move the gripper pads 81 to the retreat position indicated by the chain line in FIG. 14. At this time, the gripper pads 81 move to the retreat position, thereby forming a space in which the grippers 92 retreat into the gap 65*a*.

Subsequent to the movement of the gripper pads 81 to the retreat position, the cam follower 97 moves from the cam surface of the gripper closing cam 95 to the large-diameter portion 172*a* of the gripper moving cam 172 against the torsion spring force of the torsion bar 94. The gripper shaft 90 is pivoted through the lever 96. In accordance with the pivotal movement of the gripper shaft 90, the gripper holders 91 of the reversing gripper unit 100 are swung to move the grippers 92 to the position 92*c* shown in FIG. 14. With this operation, the grippers of the entire reversing gripper unit 100 sequentially retreat from the outer surface of the reversing cylinder 65, thereby preventing interference with the outer surface of the impression cylinder 63.

When the reversing cylinder 65 is continuously rotated, and the reversing gripper unit 100 passes through the line connecting the centers of the cylinders 63 and 65, the cam follower 97 is moved from the large-diameter portion 172*a* of the gripper moving cam 172 to the cam surface of the gripper closing cam 95 by the torsion spring force of the torsion bar 94. With this operation, the grippers 92 of the reversing gripper unit 100 are moved from the retreat position 92*c* to a position 92*b* shown in FIG. 14.

Subsequent to the movement of the grippers 92, the gripper pad bar 80 is swung by cooperation of the spring forces of the compression coil springs 84 and 86 and the torsion bar 82 and the level of the cam surface of the gripper pad moving cam 73 to bring the cam follower 72 in contact with the stop bar 77, thereby regulating the movement of the gripper pad bar 80 in the direction of the grippers 92. For this reason, the gripper pads 81 move from the retreat position indicated by the chain line in FIG. 14 to the operating position indicated by the solid line.

When the reversing cylinder 65 is continuously rotated, the cam follower 97 of the reversing gripper unit 100 is moved to the small-diameter portion 95*b* of the gripper closing cam 95 by the torsion spring force of the torsion bar 94 at the position 129G shown in FIG. 15. At this time, the grippers 92 move to the position 92*a* shown in FIG. 14, and the paper sheet 150 is gripped by the gripper pads 81 and the grippers 92 from the suckers 129. When the paper sheet 150 is to be gripped by the reversing gripper unit 100, the stop bar 77 is being fixed on the line of pressing action of the grippers 92 with respect to the gripper pads 81. Therefore, deflection of the gripper pad bar 80 is regulated, so that the gripping operation can be accurately performed.

In the sheet-fed rotary press with a reversing mechanism which operates in this manner, an air spray apparatus is provided. This apparatus will be described with reference to FIGS. 4 to 6 and 15. Referring to FIG. 6, a nipple 151 coupled to the exhaust side of a pump (not shown) by a hose 152 is threadably engaged with a screw hole formed in the outer cylinder 134 of the rotary valve 133 and open to the outer surface of the inner cylinder 136. An elongated hole 153 is formed in the inner cylinder 136 to extend from the inner surface to the outer surface. The elongated hole 153 communicates with an L-shaped air passage 138*b* provided to the rotating shaft 138 integrally arranged with the reversing cylinder 65.

In the gap 65*a* of the reversing cylinder 65, a hollow air spray bar 155 shown in FIGS. 4 and 5 is coupled to the air passage 138*b* of the rotating shaft 138 by a hose 154. The air spray bar 155 is formed to be free to pivot and axially supported between the left and right bearers 68. A plurality of air spray holes are formed in the air spray bar 155 to communicate with its inner hole. The air spray holes of the air spray bar 155 spray air between the outer surface of the first impression cylinder 63 and the paper sheet 150 separated from the outer surface of the cylinder 63.

With the above structure, as shown in FIG. 15, when the first impression cylinder 63 and the reversing cylinder 65 are rotated while being in contact with each other, air is sprayed between the outer surface of the impression cylinder 63 and the paper sheet 150 separated from the outer surface of the cylinder 63. With this operation, the paper sheet 150 is properly separated from the outer surface of the impression cylinder 63 and can be prevented from being pressed against the outer surface of the impression cylinder 63. Since the air spray bar 155 is fixed to be free to pivot and adjust its direction, air can be accurately sprayed between the first impression cylinder 63 and the paper sheet 150 separated from the outer surface of the cylinder 63.

A printing switching apparatus for switching single-sided printing to perfecting printing and perfecting printing to single-sided printing will be described below. Mainly referring to FIGS. 10 to 12, the outer surface of the reversing cylinder 65 serving as a paper convey cylinder is cut to be flat, thereby forming two gaps opposing each other. Of these two gaps, the gap 65*b* has the lever drive shaft 102 and the lever drive shaft 109, which are divided into halves at the central portion of the cylinder along the axial direction and axially supported to be parallel to each other, as described above. The proximal portions of cam levers 158 and 159 respectively having cam followers 156 and 157 pivotally mounted at the free end portions are fixed to the divided drive shafts 102 and 109 by split-clamping, respectively.

As described above, the lever 104 and the lever 111 are axially mounted on the drive shafts 102 and 109, respectively, while cam followers 105 and 112 are pressed against the sucker moving cam 106 and the sucker pivoting cam 113 of the frames 61 and 62, respectively, by the spring force of a torsion bar.

The other gap 65*c* of the reversing cylinder 65 also has the lever drive shaft 102 and the lever drive shaft 109, which are divided into halves at the central portion and axially supported to be parallel to each other, as in the gap 65*b*. The proximal portions of cam levers 162 and 163 having cam followers 160 and 161 pivotally mounted at the free end portions are fixed to the lever drive shaft 102 and the lever drive shaft 109 by split-clamping, respectively.

As described above, the lever 104 and the lever 111 are fixed on the drive shafts 102 and 109, respectively, while the cam followers 105 and 112 are pressed against the sucker moving cam 106 and the sucker pivoting cam 113 on the frames 61 and 62 side, respectively, by the spring force of a torsion bar.

On the bottom surface of the gap 65*b*, a pair of semicircular first stop cams 164 each having the cam follower 156 in contact with the cam surface at the end face are held by holders 165 having a rectangular shape viewed from the front side to be free to pivot. On the bottom surface of the gap 65*b*, a pair of sectorial second stop cams 166 each having the cam follower 157 pressed against the cam surface at the end face are held by holders 167 having a rectangular shape viewed from the front side to be free to pivot.

Although only the side view is shown in FIG. 11 and 12, the gap 65*c* also has holders 178 and 180, second stop cams 177, first stop cams 179, the cam levers 162 and 163, and the cam followers 160 and 161, and the like, all of which have the same structure as those in the gap 65*b*.

A coupling shaft 168 having a hexagon head is axially pivotally supported by each of the holders 165 in the gap 65*b* and the holders 178 in the gap 65*c*. The first stop cam 164 is fixed to the coupling shaft 168 in the gap 65*b*, and the second stop cam 177 is fixed to the coupling shaft 168 in the gap 65*c*. A coupling shaft 169 having a hexagon head is axially pivotally supported by each of the holders 178 in the gap 65*b* and the holders 67 in the gap 65*c*. The second stop cam 166 is fixed to the coupling shaft 169 in the gap 65*b*, and the first stop cam 179 is fixed to the coupling shaft 169 in the gap 65*c*.

The first stop cams 164 and 179 have the same shape. As shown in FIG. 16, the first stop cam 164 (179) is constituted by a boss portion 164*a* (179*a*) having a hole 164*b* (179*b*) in which the coupling shaft 168 (169) is fitted, and a flange portion 164*c* (179*c*) having cam surfaces 164*d* (179*d*), 164*e* (179*e*), and 164*f* (179*f*).

The cam surface constituting the flange portion 164*c* (179*c*) comprises the high horizontal surface 164*f* (179*f*), the low horizontal surface 164*d* (179*d*), and the inclined surface 164*e* (179*e*) gradually inclined upward/downward to couple the high horizontal surface 164*f* (179*f*) with the low horizontal surface 164*d* (179*d*).

With the above structure, when the first stop cam 164 (179) is pivoted, the cam follower 156 (161) moves from the horizontal surface 164*d* (179*d*) of the cam surface to the inclined surface 164*e* (179*e*) against the torsion spring force of the torsion bar 114 to move the cam lever 158 (163).

When the first stop cam 164 (179) is continuously pivoted, the cam follower 156 (161) moves to the horizontal surface 164*f* (179*f*) of the cam surface. With this operation, the lever drive shaft is pivoted through the cam lever 158 (163) to separate the cam follower 112 from the cam surface of the cam 113, thereby setting the pivoting unit of the suckers 129 in an inoperative state.

The second stop cams 166 and 177 have the same shape. As shown in FIG. 17, the second stop cam 166 (177) is constituted by a boss portion 166*a* (177*a*) having a hole 166*b* (177*b*) in which the coupling shaft 169 (168) is fitted, and a flange portion 166*c* (177*c*) having cam surfaces 166*d* (177*d*), 166*e* (177*e*), and 166*f* (177*f*).

The cam surface constituting the flange portion 166*c* (177*c*) comprises the high horizontal surface 166*f* (177*f*), the low horizontal surface 166*d* (177*d*), and the inclined surface 166*e* (177*e*) gradually inclined upward/downward to couple the high horizontal surface 166*f* (177*f*) with the low horizontal surface 166*d* (177*d*).

With the above structure, when the second stop cam 166 (177) is pivoted, the cam follower 160 (157) moves from the horizontal surface 166*d* (177*d*) of the cam surface to the inclined surface 166*e* (177*e*) against the torsion spring force of the torsion bar 107 to move the cam lever 162 (159).

When the second stop cam 166 (177) is continuously pivoted, the cam follower 160 (157) moves to the horizontal surface 166*f* (177*f*) of the cam surface. With this operation, the lever drive shaft is pivoted through the cam lever 162 (159) to separate the cam follower 105 from the cam surface of the cam 106, thereby setting the pivoting unit of the suckers 129 in the inoperative state.

As described above, since the gradient angles of the inclined surfaces 164*e*, 179*e*, 166*e*, and 177*e* of the first stop cams 164 and 179 and the second stop cams 166 and 177 are small, these stop cams can be easily moved with a small force against the biasing forces on the cam follower side.

In addition, by operating the coupling shafts 168 from the gap 65*b* side of the reversing cylinder 65, the first and second stop cams 164 and 177 can be simultaneously pivoted, thereby setting one of the two sets of suckers 129 provided to the reversing cylinder 65 in the inoperative state. Similarly, by operating the coupling shafts 169 from the gap 65*c* side of the reversing cylinder 65, the other set of suckers 129 can be set in the inoperative state. Therefore, the switching operation between perfecting printing and single-sided printing can be properly performed with a small force.

With the above structure, when perfecting printing is to be switched to single-sided printing, the upstream cylinder group including the impression cylinder 63 is phase-shifted with respect to the reversing cylinder 65 by an almost vertical length of the paper sheet 150 in the circumferential direction. Thereafter, a wrench is engaged with a hexagon head 174*b* of a pin 174 to pivot the pin 174, thereby moving the gripper pad moving cam 73 through the gears 174*a* and 173.

When a wrench is engaged with a hexagon head 176*b* of a pin 176 to pivot the pin 176, the gripper moving cam 172 is pivoted through gears 176*a* and 175. For this reason, upon rotation of the reversing cylinder 65, the reversing gripper unit 100 moves to the retreat position during the movement from the contact point between the reversing cylinder 65 and the impression cylinder 64 to the contact point between the reversing cylinder 65 and the impression cylinder 63. The reversing gripper unit 100 moves to the operating position before the reversing grippers 100 reach the contact point between the reversing cylinder 65 and the impression cylinder 63. Therefore, the paper sheet can be conveyed without any trouble during the single-sided printing operation.

Thereafter, when wrenches are engaged with the hexagon heads of the coupling shafts 168 and 169 to pivot the coupling shafts 168 and 169, the stop cams 164, 166, 177, and 179 are pivoted to oppose and push the cam followers 156, 157,160, and 161, respectively. The drive shafts 109 and 102 are pivoted to move the cam followers 112 and 105 outside the large-diameter portions of the cam surfaces of the cam 106 and the cam 113, respectively. With this operation, even when the reversing cylinder 65 is rotated, the cam followers 112 and 105 are not brought into contact with these cam surfaces, so the suckers 129 are not pivoted or moved. The suckers 129 stop while being retreated from the outer surface of the reversing cylinder 65. Therefore, the members in the pivoting and moving systems for the suckers 129 are not worn.

In this embodiment, the impression cylinders 63 and 64 are exemplified as the upstream and downstream cylinders in contact with the reversing cylinder 65. However, in place of the impression cylinders 63 and 64, transfer cylinders may also be used. Alternatively, an impression cylinder may be used as one of the upstream and downstream cylinders, and a transfer cylinder may be used as the other cylinder.

In this embodiment, the suckers 129 are exemplified as paper trailing end holding members. However, the present invention is not limited to this. For example, the paper sheet may be pierced with pins or gripped by grippers at its trailing end and conveyed. Alternatively, the pins or grippers may be used together with the suckers 129.

The reversing mechanism of this embodiment is constituted by the paper trailing end holding members such as suckers and the paper holding members such as grippers. In addition to the grippers, suckers or pins for piercing the paper sheet, or a combination of suckers and pins may also be used as the paper holding members.

In this embodiment, the cam mechanism constituted by the gripper moving cam 95, the cam follower 97, the torsion bar 94, and the like is exemplified as the cam moving unit. However, the present invention is not limited to this. A mechanism which uses, e.g., an actuator such as an air cylinder to pivot or vertically move the grippers 92 may also be used.

In this embodiment, the cam mechanism is exemplified as the moving unit for the gripper pad members. However, the present invention is not limited to this. A cam mechanism which uses, e.g., an actuator such as an air cylinder to pivot or move the gripper pads 81 in the vertical, horizontal, or inclined direction may also be used.

As is apparent from the above description, according to the present invention, the gripper pads can increase the gripper pressure of the paper holding unit, thereby accurately gripping the paper sheet without any erroneous paper direction. For this reason, printing failures are decreased to improve the quality of printing matter and reduce wasted paper. In addition, deflection of the gripper pad shaft can be prevented to accurately grip the paper sheet without any erroneous paper direction. Printing failures are further decreased to improve the quality of printed matter and further reduce wasted paper.

What is claimed is:

1. A sheet reversing apparatus for a sheet-fed rotary press with a reversing mechanism, comprising:

a paper convey cylinder disposed between an upstream cylinder and a downstream cylinder with respect to a paper convey direction to be in contact with each other;

a gap formed along an axial direction of said paper convey cylinder at a position which divides a circumference of said paper convey cylinder into halves in a circumferential direction;

a reversing mechanism, disposed in said gap, for holding a trailing end of a paper sheet passing through a contact point between said paper convey cylinder and said upstream cylinder and wound on said upstream cylinder, and then reversing and transferring said paper sheet to said downstream cylinder, said reversing mechanism having a paper holding unit, having a gripper member and a gripper pad member for receiving and holding said reversed paper sheet, for transferring said paper sheet held between said gripper member and said gripper pad member to said downstream cylinder;

a gripper moving unit for moving said gripper member of said paper holding unit from said gap to an outer surface of said paper convey cylinder in accordance with a pivotal movement of said paper convey cylinder; and a gripper pad moving unit for moving, in accordance with the pivotal movement of said paper convey cylinder, said gripper pad member of said paper holding unit between an operating position at which a distal end of said gripper member presses a paper grip surface of said gripper pad member to grip said paper sheet and a retreat position at which a space is formed to entirely receive said gripper member moved by said gripper moving unit from said outer surface of said paper convey cylinder into said gap.

2. An apparatus according to claim 1, wherein, immediately before said paper holding unit reaches a contact point between said paper convey cylinder and said upstream cylinder, said gripper pad moving unit moves said gripper pad member to the retreat position, and thereafter, said gripper moving unit moves said gripper member into said gap, and after said paper holding unit passes through the contact point between said paper convey cylinder and said upstream cylinder, said gripper moving unit moves said gripper member from said gap to said outer surface of said paper convey cylinder, and thereafter, said gripper pad moving unit moves said gripper pad member to the operating position.

3. An apparatus according to claim 1, wherein said gripper member is arranged to a support shaft having two ends pivotally supported, and said gripper moving unit is constituted by a first cam mechanism operated in accordance with the pivotal movement of said paper convey cylinder to pivot said support shaft such that said gripper member is retreated into said gap, and a first pivoting mechanism for pivoting said support shaft in accordance with an operation of said first cam mechanism.

4. An apparatus according to claim 3, wherein said first cam mechanism has a gripper moving cam member having a first cam surface for moving said gripper member, a gripper closing cam member having a second cam surface, continuously extending from said first cam surface, for opening/closing said gripper member, and a cam follower in contact with said gripper moving member and said gripper closing member and coupled to said first pivoting mechanism, said gripper closing cam member and said gripper moving cam member opening/closing and moving said gripper member in accordance with a phase of said pivoting paper convey cylinder.

5. An apparatus according to claim 4, wherein said gripper moving cam member and said gripper closing cam member overlap each other in a direction of width of said cam follower and are selectively brought into contact with said first and second cam surfaces in halved regions of said cam follower in the direction of width, respectively.

6. An apparatus according to claim 1, wherein said gripper pad member is arranged to a support bar having two ends pivotally supported, and said gripper pad moving unit is constituted by a second cam mechanism operated in accordance with the pivotal movement of said paper convey cylinder, and a second pivoting mechanism for pivoting said support bar in accordance with an operation of said second cam mechanism.

7. An apparatus according to claim 1, wherein said reversing mechanism has a plurality of paper trailing end holding members, arranged near said paper holding unit and aligned in said gap along the axial direction of said paper convey cylinder at a predetermined interval, for drawing and holding said trailing end of said paper sheet, and, when said paper holding unit retreats in said gap, said paper trailing end holding members draw and hold said trailing end of said paper sheet wound on said upstream cylinder.

8. An apparatus according to claim 1, further comprising a regulating member, arranged in said gap on a line of action of a pressing force which acts on said paper grip surface of said gripper pad member at the operating position, for regulating a movement of said gripper pad member in a radial direction of said paper convey cylinder.

* * * * *